US009776073B2

(12) United States Patent
Nicolas

(10) Patent No.: US 9,776,073 B2
(45) Date of Patent: Oct. 3, 2017

(54) METHODOLOGY FOR CREATING SETS OF RELATED WORD GAMES AND PUZZLES BASED ON LINKING RATIONALLY CHOSEN LETTER PAIRS AND/OR TRIPLETS AND LINKING WORDS THAT ARE TRANSFORMATIONS OF EACH OTHER

(71) Applicant: Edgar C. Nicolas, Exton, PA (US)

(72) Inventor: Edgar C. Nicolas, Exton, PA (US)

( * ) Notice: Subject to any disclaimer, the term of this patent is extended or adjusted under 35 U.S.C. 154(b) by 0 days.

(21) Appl. No.: 14/976,783

(22) Filed: Dec. 21, 2015

(65) Prior Publication Data

US 2016/0107074 A1 Apr. 21, 2016

Related U.S. Application Data

(60) Continuation of application No. 14/485,061, filed on Sep. 12, 2014, now abandoned, which is a division of application No. 14/009,689, filed as application No. PCT/US2012/032370 on Apr. 5, 2012, now abandoned.

(60) Provisional application No. 61/471,731, filed on Apr. 5, 2011.

(51) Int. Cl.

| | |
|---|---|
| ***A63F 3/04*** | (2006.01) |
| ***A63F 9/00*** | (2006.01) |
| *A63F 3/00* | (2006.01) |
| *A63F 9/20* | (2006.01) |

(52) U.S. Cl.

CPC ..... *A63F 3/0423* (2013.01); *A63F 3/00097* (2013.01); *A63F 9/0098* (2013.01); *A63F 9/20* (2013.01); *A63F 2003/00867* (2013.01); *A63F 2003/0428* (2013.01)

(58) Field of Classification Search

CPC ..... A63F 3/0423; A63F 9/00; A63F 3/04

See application file for complete search history.

(56) References Cited

U.S. PATENT DOCUMENTS

| | | | | |
|---|---|---|---|---|
| 3,464,124 | A * | 9/1969 | Lynd | G09B 17/00 273/269 |
| 5,374,065 | A | 12/1994 | Motskin | |
| 5,556,102 | A * | 9/1996 | Huang | A63F 3/0423 273/299 |
| 6,412,781 | B1 * | 7/2002 | Lund | A63F 1/02 273/272 |
| 6,575,468 | B1 | 6/2003 | Hall | |
| 6,655,688 | B2 | 12/2003 | Boateng | |
| 6,769,692 | B1 | 8/2004 | Cavalluzzo | |
| 2014/0021683 | A1 | 1/2014 | Nicolas | |

OTHER PUBLICATIONS

M. Wiickenheiser "Aroostook businessman expands company out of home with hit mobile app 7 little words"; Article from Internet; May 2011.

(Continued)

*Primary Examiner* — Michael Dennis

(74) *Attorney, Agent, or Firm* — Panitch Schwarze Belisario & Nadel LLP

(57) ABSTRACT

A word game for being played among one or more participants includes a plurality of two letter word bits, each having a fixed letter combination, wherein the one or more participants attempt to create words of at least four letters by combining the word bits.

5 Claims, 24 Drawing Sheets

| | | | | | | | | | |
|---|---|---|---|---|---|---|---|---|---|
| 5 A | 2 B | 3 C | 4 D | 11 E | 2 F | 2 G | 2 H | 4 I | 1 J |
| 1 K | 3 L | 2 M | 3 N | 4 O | 2 P | 1 Q | 6 R | 7 S | 5 T |
| 2 U | 1 V | 2 W | 1 X | 3 Y | 1 Z | | | | |

11

| | | | | | | | | | |
|---|---|---|---|---|---|---|---|---|---|
| CE | CO | FA | HU | ID | IR | LD | LE | LK | MI |
| RU | RY | SA | SL | SS | TE | UG | VA | VI | WH |
| AL | AM | AN | BE | BI | CA | CL | EL | EN | FI |
| FU | HE | IN | LU | MA | PL | RD | RK | RT | SH |
| AB | BA | CK | CR | DI | FT | GI | HA | IL | IT |
| LI | LO | LY | MU | OK | OL | RN | SC | SU | TO |
| BU | DA | GA | GO | HO | IM | KE | MB | MP | NO |
| OP | PA | PO | SK | TA | TH | UN | UR | VE | WO |
| AK | AW | AY | BR | DO | DR | EA | ED | EE | EW |
| HI | KN | LA | NT | OR | PR | SO | ST | TR | WN |
| AP | CH | CU | DU | EK | ET | IP | JA | KI | ND |
| NK | OT | PE | PI | RA | RE | SI | SP | SW | WE |
| AD | AR | BL | DE | EM | ER | EY | FE | GE | GL |
| GR | JE | ME | OW | RM | RO | SE | TI | WA | ZE |
| AG | AT | BO | FL | FO | FR | JO | LL | LT | MO |
| NA | NE | NG | OD | OM | ON | PU | RI | TU | WI |
| AC | AX | DY | EP | EX | FF | GU | JU | OB | OV |
| QU | SN | TY | UB | UD | UM | UT | WL | YO | ZO |

12

(56) References Cited

OTHER PUBLICATIONS

7 Little Words website; http://www.7littlewords.com; 2013.
Int'l Search Report and Written Opinion dated Jun. 28, 2012 in Int'l Application No. PCT/US2012/032370.
Office Action dated Dec. 10, 2013 in U.S. Appl. No. 14/009,689.
Office Action dated Jun. 12, 2014 in U.S. Appl. No. 14/009,689.

* cited by examiner

Fig. 1A

| | | | | | | | | | |
|---|---|---|---|---|---|---|---|---|---|
| 5 A | 2 B | 3 C | 4 D | 11 E | 2 F | 2 G | 2 H | 4 I | 1 J |
| 1 K | 3 L | 2 M | 3 N | 4 O | 2 P | 1 Q | 6 R | 7 S | 5 T |
| 2 U | 1 V | 2 W | 1 X | 3 Y | 1 Z | | | | |

11

Fig. 1B

| | | | | | | | | | |
|---|---|---|---|---|---|---|---|---|---|
| CE | CO | FA | HU | ID | IR | LD | LE | LK | MI |
| RU | RY | SA | SL | SS | TE | UG | VA | VI | WH |
| AL | AM | AN | BE | BI | CA | CL | EL | EN | FI |
| FU | HE | IN | LU | MA | PL | RD | RK | RT | SH |
| AB | BA | CK | CR | DI | FT | GI | HA | IL | IT |
| LI | LO | LY | MU | OK | OL | RN | SC | SU | TO |
| BU | DA | GA | GO | HO | IM | KE | MB | MP | NO |
| OP | PA | PO | SK | TA | TH | UN | UR | VE | WO |
| AK | AW | AY | BR | DO | DR | EA | ED | EE | EW |
| HI | KN | LA | NT | OR | PR | SO | ST | TR | WN |
| AP | CH | CU | DU | EK | ET | IP | JA | KI | ND |
| NK | OT | PE | PI | RA | RE | SI | SP | SW | WE |
| AD | AR | BL | DE | EM | ER | EY | FE | GE | GL |
| GR | JE | ME | OW | RM | RO | SE | TI | WA | ZE |
| AG | AT | BO | FL | FO | FR | JO | LL | LT | MO |
| NA | NE | NG | OD | OM | ON | PU | RI | TU | WI |
| AC | AX | DY | EP | EX | FF | GU | JU | OB | OV |
| QU | SN | TY | UB | UD | UM | UT | WL | YO | ZO |

12

Fig. 1C

13

| | | | | | | | | | |
|---|---|---|---|---|---|---|---|---|---|
| BLA | CHA | CRA | FLA | GLE | PLU | SHE | SNA | STI | THO |
| BLE | CHE | CRE | FLE | GLO | PRA | SHI | SNI | STO | TRA |
| BLI | CHI | CRI | FLI | GRA | PRE | SHO | SNO | STU | TRE |
| BLO | CHO | CRO | FLO | GRE | PRI | SHU | SPA | SWA | TRI |
| BLU | CHU | CRU | FLU | GRI | PRO | SKI | SPE | SWE | TRO |
| BRA | CLA | DRA | FRA | GRO | QUA | SLA | SPI | SWI | TRU |
| BRE | CLE | DRE | FRE | KNO | QUI | SLE | SPO | SWO | WHA |
| BRI | CLI | DRI | FRI | PLA | SCA | SLI | SPU | THA | WHE |
| BRO | CLO | DRO | FRO | PLE | SCO | SLO | STA | THE | WHI |
| BRU | CLU | DRU | GLA | PLO | SHA | SLU | STE | THI | WHO |
| ACK | ANK | ASP | ELT | EST | ING | ISS | ONG | OSS | UMB |
| AFT | ANT | ASS | END | ICK | INK | IST | ONK | OST | UMP |
| ALD | ARD | AST | ENT | IFT | INT | OCK | ONT | OTH | UNG |
| ALK | ARK | AWL | ERD | ILD | IRD | OLD | ORD | OWL | UNK |
| ALL | ARM | AWN | ERK | ILK | IRM | OLL | ORK | OWN | UNT |
| ALT | ARN | ECK | ERM | ILL | IRT | OLT | ORM | UCH | URN |
| AMP | ART | EFT | ERN | ILT | ISH | OMB | ORN | UCK | URT |
| AND | ASH | ELD | ESH | IMP | ISK | OMP | ORT | ULK | USH |
| ANG | ASK | ELL | ESS | IND | ISP | OND | OSH | ULL | UST |

14

Fig. 2

| | | | | | | | |
|---|---|---|---|---|---|---|---|
| BANK | BASS | BOND | BASE | DULL | MINK | LINK | BUSH |
| BARK | MASS | BONE | CASE | PULL | MINT | PINK | PUSH |
| BARN | PASS | CONE | VASE | POLL | PINT | SINK | GUSH |
| CAPE | CARE | CASH | BASK | HATE | HIRE | HOLE | DOTE |
| CAGE | CAVE | MASH | MASK | LATE | SIRE | HOPE | NOTE |
| RAGE | SAVE | WASH | TASK | MATE | TIRE | ROPE | NOSE |
| BELL | BILL | BEST | FATE | HOSE | LICK | ROCK | FILE |
| SELL | MILL | BEAT | GATE | ROSE | LOCK | RACK | FINE |
| TELL | TILL | SEAT | GAVE | ROLE | LUCK | SACK | FIRE |
| COOK | CAST | HILL | GUST | LAND | LACK | LIVE | KICK |
| HOOK | COST | HELL | JUST | LEND | TACK | LINE | KINK |
| LOOK | LOST | WELL | JEST | MEND | TICK | MINE | KING |
| CORE | DARK | DARE | LAKE | SEND | CARD | PICK | NINE |
| CORK | HARK | DART | LIKE | TEND | WARD | SICK | NICE |
| WORK | HARD | PART | LICE | TENT | WARN | SOCK | NICK |
| DUCK | DONE | DOVE | MIKE | SING | MORE | RANK | VICE |
| PUCK | DOSE | LOVE | MAKE | WING | PORE | RANG | VISE |
| TUCK | LOSE | MOVE | TAKE | WIND | SORE | RING | RISE |

21

Fig. 3A
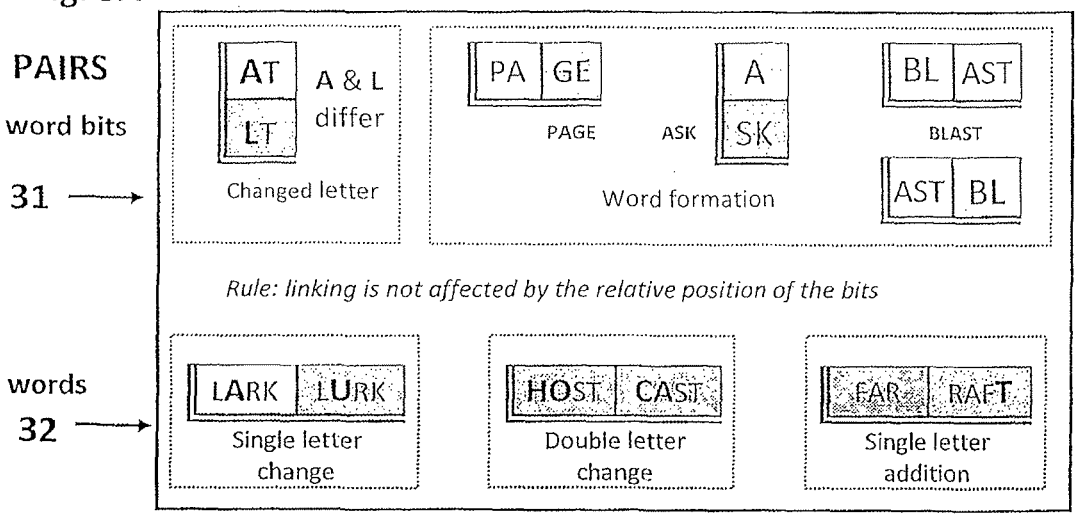
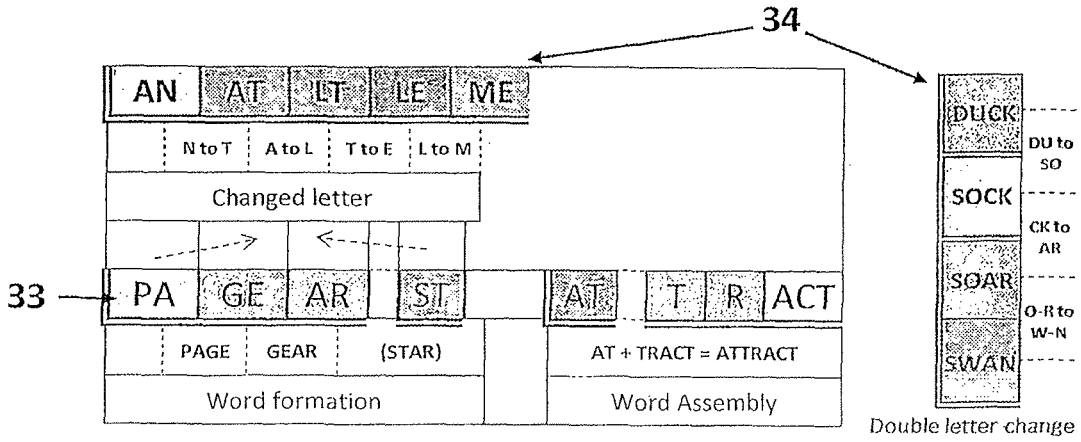
Fig. 3B

Fig. 5A
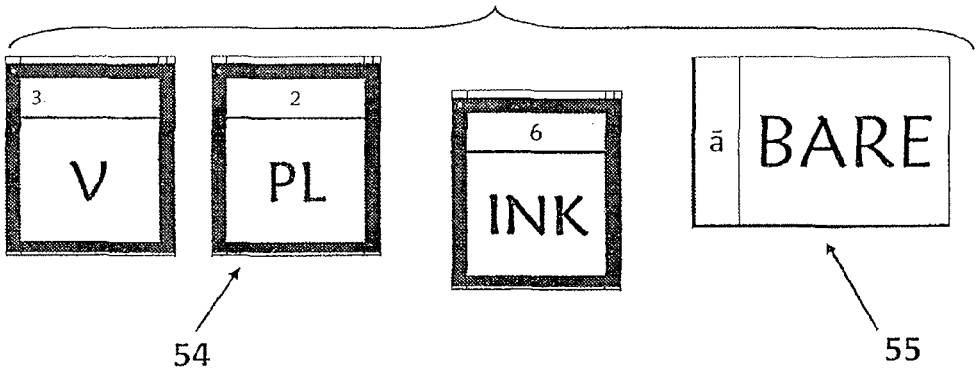
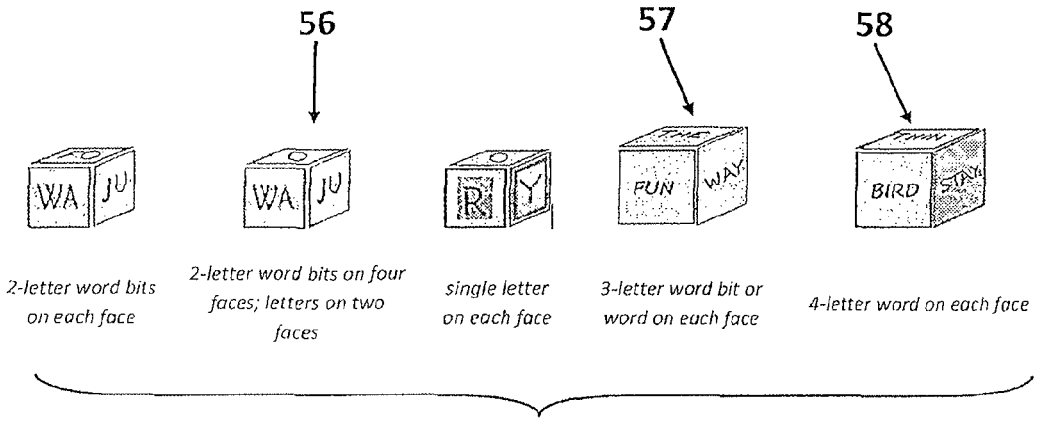
Fig. 5B

Fig. 9A

91

WordBits
COLOR GROUP

| 3 | 4 | 7 | 8 |
|---|---|---|---|
| AB | BU | AD | AG |
| CK | GA | BL | BO |
| DI | HO | EM | FO |
| GI | KE | EY | JO |
| IL | MP | GE | LT |
| LI | OP | GR | NA |
| LY | PO | ME | NG |
| OK | TA | RM | OM |
| RN | UN | SE | PU |
| SU | VE | WA | TU |
| BA | DA | AR | AT |
| CR | GO | DE | FL |
| FT | IM | ER | FR |
| HA | MB | FE | LL |
| IT | NO | GL | MO |
| LO | PA | JE | NE |
| MU | SK | OW | OD |
| OL | TH | RO | ON |
| SC | UR | TI | RI |
| TO | WO | ZE | WI |

Fig. 9B

92

93

BICOLOR FORTY-FOURS SOLUTION

| PAIRS | | GROUPS | | PAIRS | | GROUPS | |
|---|---|---|---|---|---|---|---|
| BL | AB | 7 | 3 | MO | DE | 8 | 7 |
| BU | CK | 4 | 3 | MU | SE | 3 | 7 |
| CR | AG | 3 | 8 | NA | IL | 8 | 3 |
| DA | RN | 4 | 3 | NE | AR | 8 | 7 |
| DI | KE | 3 | 4 | ON | LY | 8 | 3 |
| FE | AT | 4 | 8 | PA | NG | 4 | 8 |
| FL | OW | 8 | 7 | PO | EM | 4 | 7 |
| FO | OL | 8 | 3 | PU | MP | 8 | 4 |
| FR | IT | 8 | 3 | RI | SK | 8 | 4 |
| GA | ZE | 4 | 7 | RO | OK | 7 | 3 |
| GI | VE | 3 | 4 | SC | AD | 3 | 7 |
| GL | OP | 7 | 4 | SU | ER | 3 | 7 |
| GO | OD | 4 | 8 | TA | ME | 4 | 7 |
| GR | IM | 7 | 4 | TI | LT | 7 | 8 |
| HA | TH | 3 | 4 | TU | BA | 8 | 3 |
| HO | BO | 4 | 8 | UN | TO | 4 | 3 |
| JE | LL | 7 | 8 | UR | GE | 4 | 7 |
| JO | EY | 8 | 7 | WA | FT | 7 | 3 |
| LI | MB | 3 | 4 | WI | NO | 8 | 4 |
| LO | OM | 3 | 8 | WO | RM | 4 | 7 |

3 uncommon words (DIKE, JOEY, SUER): Score = 117

| Turn 1 | |
|---|---|
| CR | CROSS |
| O | *CROSS* |
| SS | *CROSS* |

| Turn 2 | |
|---|---|
| SE | SECRET |
| E | *SECRET* |
| T | *SECRET* |

| Turn 3 | |
|---|---|
| M | MESSY |
| E | *MESSY*, EM |
| Y | *MESSY* |

| Turn 4 | |
|---|---|
| AR | MAR, ARM, BEAR |
| BE | BEE, *BEAR* |
| | |

| Turn 5 | |
|---|---|
| S | ARMS, SHOTS |
| T | SET, BEET, *SHOTS* |
| SH | SHY, SHE, *SHOTS* |

| Turn 6 | |
|---|---|
| RE | RESET, FLARE |
| A | ACROSS, *FLARE* |
| FL | FLESHY, *FLARE* |

131
00:00
132
133

A Z E L
Z E A L
Dealt: A Z E L
Used: A Z E L

S
Z E A L
Dealt: S
Used: none

S I
Z E A L
Dealt: I
Used: none

S I T
Z E S T
Dealt: T
Used: S T

R I M
M I S T
Dealt: R M
Used: M I

R O N Y
E
M I N E
Dealt: O N Y E
Used: N E

R O Y
M O R E
Dealt: none
Used: O R

B W M Y
H
H O M E
Dealt: B W M H
Used: H M

B W O Y
Z O P
H Y P E
Dealt: O Z O P
Used: Y P

B W O U
Z O I J
G
H U G E
Dealt: I J G
Used: U G

B W O G
Z O I J
C A
W A G E
Dealt: G C A
Used: W A

B A O G
Z O I J
C E H E
W A G E
Dealt: A E H
Used: none

Fig. 16A

| GRP 4 WORD BITS | | 10 FOURS solution | |
|---|---|---|---|
| BU | NO | HO | UR |
| DA | OP | DA | TA |
| EN | PO | GA | VE |
| GA | SK | MO | TH |
| HO | TA | NO | UN |
| IM | TH | OP | EN |
| KE | UN | PO | KE |
| MB | UR | BU | MP |
| MO | VE | SK | IM |
| MP | WO | WO | MB |

Score = 20

161

Fig. 16B

| GRP 5 WORD BITS | | 10 FIVES solution | | | WORD SCORE |
|---|---|---|---|---|---|
| AK | HI | B | EA | ST | 2 |
| AY | KN | BR | E | AK | 3 |
| AW | LA | DO | N | OR | 3 |
| BR | NT | DR | AW | L | 2 |
| DO | OR | HI | NT | S | 1 |
| DR | PR | KN | O | WN | 3 |
| EA | SO | S | EW | ED | 2 |
| ED | ST | S | PR | EE | 2 |
| EE | TR | S | TR | AY | 2 |
| EW | WN | SO | LA | R | 2 |
| | | | | Total score | 22 |

162

Fig. 16C

| GRP 1 WORD BITS | | 10 SIXES solution | | | | WORD SCORE |
|---|---|---|---|---|---|---|
| CE | RU | A | D | VI | CE | 3 |
| CO | RY | A | F | FA | IR | 3 |
| FA | SA | C | E | LE | RY | 3 |
| HU | SI | CO | UG | A | R | 3 |
| ID | SS | HU | N | TE | R | 4 |
| IR | TE | MI | LD | E | W | 3 |
| LD | UG | RU | SS | E | T | 3 |
| LE | VA | SA | L | I | VA | 5 |
| LK | VI | SI | ID | E | R | 2 |
| MI | WH | WH | E | LK | S | 3 |
| | | | | | Total score | 32 |

163

Fig. 18A 181 180 182 181

| ROW | P | U | R | P | L | E | VOWEL FINDER |
|---|---|---|---|---|---|---|---|
| 1 | | | | | | | CVCCCV |
| 2 | | | | | | | CVCCCV |
| 3 | | | | | | | CVCCCV |
| 4 | | | | | | | CVCCVC |
| 5 | | | | | | | CVCCVC |
| 6 | | | | | | | CVCCVC |
| 7 | | | | | | | CVCCVC |
| | V | I | O | L | E | T | CVVCVC |

HIDDEN LINKS
Row 3: 87YG4SGFEHJTBVTFJLCXEGT6
Row 7: V65RPNGIJFGHJLMYEBRTFW65

Fig. 18C

183

| ROW | P | U | R | P | L | E | VOWEL FINDER |
|---|---|---|---|---|---|---|---|
| 1 | S | U | P | P | L | E | CVCCCV |
| 2 | S | U | B | T | L | E | CVCCCV |
| 3 | S | E | T | T | L | E | CVCCCV |
| 4 | S | E | T | T | E | R | CVCCVC |
| 5 | S | E | L | L | E | R | CVCCVC |
| 6 | P | E | L | L | E | T | CVCCVC |
| 7 | P | I | G | L | E | T | CVCCVC |
| | V | I | O | L | E | T | CVVCVC |

HIDDEN LINKS
Row 3: 87YG4SGFEHJTBVTFJLCXEGT6
Row 7: V65RPNGIJFGHJLMYEBRTFW65

| words | | | | clues | |
|---|---|---|---|---|---|
| H | O | S | E | Watering aid | 1 |
| S | O | M | E | Not all | |
| S | A | L | E | Store promotion | 3 |
| L | A | N | E | Path for walking | |
| L | O | N | G | Lengthy | |

Pick a letter from each word from the top row to the bottom, and enter them in these squares.

| A greeting: | | | | |
|---|---|---|---|---|
| H | E | L | L | O |

METHODOLOGY FOR CREATING SETS OF RELATED WORD GAMES AND PUZZLES BASED ON LINKING RATIONALLY CHOSEN LETTER PAIRS AND/OR TRIPLETS AND LINKING WORDS THAT ARE TRANSFORMATIONS OF EACH OTHER

CROSS-REFERENCE TO RELATED APPLICATIONS

This application is a continuation of U.S. application Ser. No. 14/485,061, filed on Sep. 12, 2014, which is a divisional application of U.S. patent application Ser. No. 14/009,689, filed on Oct. 3, 2013 as a section 371 of International Application No. PCT/US2012/032370, filed Apr. 5, 2012, which was published in the English language on Oct. 11, 2012 under International Publication No. WO 2012/138893 which claims the benefit of U.S. Provisional Patent Application No. 61/471,731, filed Apr. 5, 2011, the entire disclosures of all of which are incorporated herein by reference.

BACKGROUND OF THE INVENTION

Embodiments of the present invention are directed to word games, and more particularly, to word games based on linking letter pairs or triplets and linking words that are transformations of each other.

For entertainment, education, and for maintenance or restoration of good brain function, there are innumerable kinds of word puzzles and games. None are based on linking word parts (letter combinations in a fixed arrangement such as "LE" and "ARN", which we will call "word bits") to build words. Very few are known that are based on linking words based on the similarities and differences of their letter patterns, such as MINE and WIND (which differ by the first and fourth letters) beyond one-letter differences. Word games for players who do not know how to read words or even the letters of the alphabet are also unknown.

For building words, there are innumerable popular games and puzzles of various shapes and forms where words are created and/or transformed, but all involve linking individual letters. Games like "SCRABBLE," "BOGGLE," and "BANANAGRAMS," and puzzles like "JUMBLE" are familiar to many. Newer games like "DABBLE" and "BULL'S EYE" are being introduced still. U.S. Pat. No. 6,986,512 B2 describes a word assembly game where individual letters are used to build and to steal words from opponents. U.S. Patent Application Publication No. 2010/0009736 describes a word building game where individual letters are extracted from two different words. In schools, there are games and activities involving letter sets used for teaching, but they are not very sophisticated or interesting. What has been lacking is the approach of utilizing word bits to create a completely different family of linking-based activities that are diverse and fun and can be played over and over.

Embodiments of the present invention mainly involve the use of word bits instead of or in addition to individual letters. The word bit is an indivisible unit, and so letters in the word bits cannot be rearranged. Pairing just two two-letter word bits is enough to form a four-letter word; and many of the games of the present invention have been designed around this concept. In addition, multiple word bits can be combined (each adjacent pair forming a word) into straight and branched chains. To illustrate, BA-RE-ST-AR-BE is a short chain that contains the words BARE, REST, STAR, and BEAR. Note that the above chain is identical to BE-AR-ST-RE-BA; and relative orientation of two bits does not affect the word formation. Branching is accomplished by linking to a unit within the chain (e.g., AY to ST to form STAY), and multiple branching can lead to loops and clusters. This linking operation, not possible with individual letters, is the basis for many of the games and puzzles described herein. Many games have variations where adjacent word bits don't have to form a word but should differ by a letter, and these are good for non-readers or non-English speakers. Related games include "DOMINOS," which is not a word game, and the more complicated whole-word chaining game described in U.S. Pat. No. 6,116,604. U.S. Pat. No. 6,623,009 mentions a word game with game cards containing multiple, random letters, but these letters are not used together like word bits in forming words.

For linking words, the classic game (a puzzle) is Lewis Carroll's centuries old "Doublets," where one word is transformed to another (the target word) via a series of intermediate words that change one letter at a time. An example of this "word chain" puzzle is DUCK to SWAN, the solution being DUCK to DOCK to SOCK to SOAK to SOAP to SWAP to SWAN. U.S. Pat. No. 5,393,062 describes a computer program for creating and solving Doublets puzzles. The limitation of Carroll's Doublets is that in the collection there are only a few hundred pairs of related words, usually short (3-5 letters long). For longer words few puzzles exist, and the solutions are usually difficult long chains. There is no form of assistance given to the player other than to specify the number of steps. Finally, Parker Brothers' "SCRABBLE SLAM" is a commercialized card game where words are continuously transformed one letter at a time, but with no target word. The serious limitation of these games with single-letter changes is that, for any particular word, the possible transformations are few in number, so that few words can be generated.

Making word chain puzzles like Carroll's Doublets has been improved by embodiments of the present invention in at least two major ways: (1) by presenting the puzzle in an innovative grid that contains built-in guides as well as optional aids that are readily available but easy to forgo; and (2) by changing the word-to-word transformation from a one-letter change to a two-letter change (or even a three-letter change). Changing two or three letters at a time allows transformation of a word to many more new words, such that many paths to the target word are possible. So the creation of puzzles with longer words and shorter solutions, and/or with more interesting pairs of words however diverse, has been accomplished.

Doublets puzzles where the related words to be linked do not have to be of the same length have been made possible by combining the transformation of letter replacement with the addition of one or two letters and removal of one or two letters. This new approach has allowed the creation of a new breed of doublets. These are especially suitable as educational puzzles, using as word pairs synonyms, antonyms, and associated words such as ADHERE to STICK, GIGANTIC to SMALL, and CARDIAC to HEART.

BRIEF SUMMARY OF THE INVENTION

An embodiment of the present invention is directed to a word game for being played among one or more participants. The game includes a plurality of two letter word bits, each having a fixed letter combination, wherein the one or more participants attempt to create words of at least four letters by combining the word bits in pairs, chains, or clusters. In preferred embodiments, the game further includes individual letters and three letter word bits that can be used in word formation.

Another embodiment of the present invention is directed to a word game for being played among one or more participants. The game includes a grid having at least three rows and at least three columns which intersect to form sections. Each section is configured to receive a letter. The grid sections in the rows located between the first and last rows of the grid initially are empty. A starting word is provided in the first row of the grid and is formed by a plurality of letters. A target word is provided in the last row of the grid and is formed by a plurality of letters. The starting word and the target word are different. A guide is disposed within the grid and is configured to provide assistance to the one or more participants in completing the word game. The one or more participants attempt to complete the word game by filling in the initially empty grid sections with letters such that a word formed by the letters in any row of the grid is linked to a word formed by the letters in an adjacent row by double letter change.

Yet another embodiment of the present invention is directed to a word game for being played among one or more participants. The game includes a first grid having a plurality of rows and a plurality of columns which intersect to form sections, each section being configured to receive a letter. The grid sections initially are empty. A second grid has a plurality of initially empty spaces, the number of empty spaces corresponding to the number of rows in the first grid. The game further includes a list of clues having a word as a solution, each clue corresponding to a respective one of the plurality of rows of the first grid or the second grid. The one or more participants attempt to complete the word game by filling in the grid sections of the first grid such that a word formed by the letters in a row of the grid is linked to a word formed by the letters in a preceding row by one of single letter change, double letter change, or triple letter change, and by filling in the spaces of the second grid using a letter from each of the rows of the first grid.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 1A is a diagram representing a set of individual letter word bits for use with certain preferred embodiments of the present invention;

FIG. 1B is a diagram representing a set of two-letter word bits for use with certain preferred embodiments of the present invention;

FIG. 1C is a diagram representing a set of three-letter word bits for use with certain preferred embodiments of the present invention;

FIG. 2 is a diagram representing a subset of four-letter words for use with certain preferred embodiments of the present invention;

FIG. 3A is a diagram representing possible configurations of pairs of words and word bits in accordance with certain preferred embodiments of the present invention;

FIG. 3B is a diagram representing possible configurations of chains of words and word bits in accordance with certain preferred embodiments of the present invention;

FIG. 5A is a top plan view of word bit cards and word cards for use with certain preferred embodiments of the present invention;

FIG. 5B is a front perspective view of word bit cubes and word cubes for use with certain preferred embodiments of the present invention;

FIG. 9A is a schematic representation of word bits for use with a fourth preferred embodiment of the present invention;

FIG. 9B is a schematic representation of a solution including the word bits of FIG. 9A;

FIG. 16A is a schematic representation of word bits and a possible solution for use in a twelfth embodiment of the present invention;

FIG. 16B is a schematic representation of word bits and a possible solution for use in a thirteenth embodiment of the present invention;

FIG. 16C is a schematic representation of word bits and a possible solution for use in a fourteenth embodiment of the present invention;

FIG. 18A is a schematic representation of a puzzle in accordance with a nineteenth embodiment of the present invention;

FIG. 18C is the full solution to the puzzle of FIG. 18A;

DETAILED DESCRIPTION OF THE INVENTION

Figure 3C:
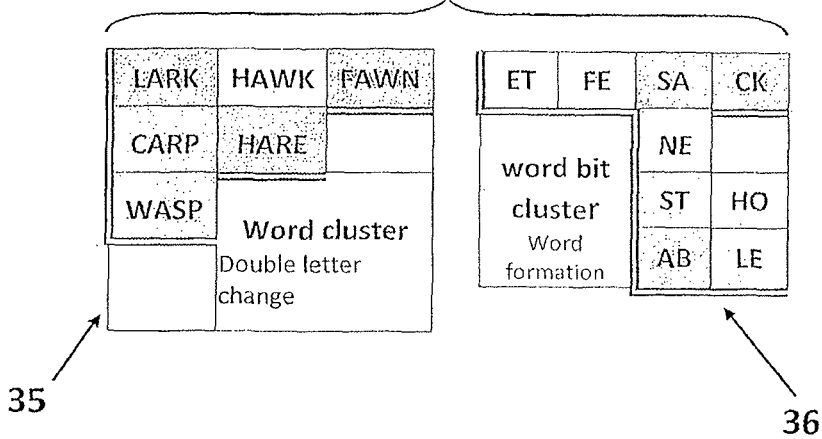
FIG. 3C is a diagram representing possible configurations of clusters of words and word bits in accordance with certain preferred embodiments of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the object and designated parts thereof. The terminology includes the above-listed words, derivatives thereof, and words of similar import. Additionally, the words "a" and "an", as used in the claims and in the corresponding portions of the specification, mean "at least one."

Embodiments of the invention described herein are directed to word games for being played among one or more participants or players. Each game preferably includes a set of rules, which are described herein for various embodiments.

The name "WordLinks" is used to refer to the invented game system of fun and progressively educational games (including puzzles). All involve linking; and most have linking variations derived from two complementary concepts ("WordBits" and "Word Mutation").

"Word bits" are building blocks of words consisting of combinations of two or three letters in a particular order. A set of word bits chosen and organized for maximum fun, versatility, and educational value has been created (the "WordBits Set"). Single letters are also word building blocks and are sometimes used along with word bits in the games. The common object of many WordLinks games is to link word bits to form words that are preferably two to six letters long, although longer words may be used. The thinking process and game dynamic are different from when only individual letters are used.

"Word mutation" refers mostly to word transformations involving the replacement, addition, or removal of one or two letters. However, transformation of long words by replacing three or more letters is also done. Finally, single letter replacement is possible as a transformation process for word bits. When one word is transformed to the other, the process is reversible, and the two words are in fact "linked" by the defined difference between them. Therefore, word mutation is a way to link words (and word bits) based on letter recognition and pattern matching.

A set of common four-letter words featuring the most common word bits and chosen and organized for maximum fun, versatility, and educational value has been created. This "Word Mutation Set" complements the WordBits set as part of WordLinks. Although there are a few exceptions, most WordLinks games can be played in exactly the same way using linking by word formation (using, e.g., word bit tiles) or linking by word mutation (using, e.g., word bit or word tiles). Most anyone can play the word mutation variation of some games including kids still learning their alphabet and non-English speakers.

The games can be played for fun and relaxation, competition, education and skills development, socialization, and clinical intervention. All games and the way they are played (versions and variations) have been characterized according to the number of players, player skills needed, benefits provided, complexity, and type of activity. People can play alone, with one other person, in a group of up to eight, or as part of a roomful of players. Play can range from leisurely to furiously fast, and players can choose their pace. Players can control the number of rounds and other game variables in order to have shorter or longer games. Handicapping to allow less experienced players to compete against good players is easily done. The games have been designed to be simple to learn but continuously challenging. People play at their skill level (because the level of difficulty can often be controlled) and advance to higher levels as they gain experience.

The basic operation of linking of units (word bits or words) has been described. The units are linked into pairs, simple chains, or clusters (highly branched chains with units linked to multiple other units). The word bits and words are preferably in the physical form of tiles (although cards, cubes, die, chips, tokens, polyhedra, spheres, or other like physical representations may be used); or on paper (usually for puzzles); or within an electronic program or computer application.

Puzzles are normally solitary activities, but they can be solved by teams. They have difficulty levels assigned so that players can start with easy puzzles and then rise to their own skill level. There are features and optional guides that allow a player to play within his ability and still succeed. Some have multiple solutions beyond the best one, and so a player can tackle a puzzle several times in attempts to improve his performance.

Described herein are five basic WordLinks games which differ according to the game objective. All games have versions, and a game or versions usually has variations from which to choose. All games use the WordBits and/or Word Mutation tile set (either physical or electronic) or a part of it, and a few require accessorial game pieces. Some puzzles use the word bits tiles, while some require only the printed or electronic puzzle. Most of the games and puzzles have common elements and procedures as mentioned above.

There are common goals, operations, and terms from game to game. They are briefly explained below, illustrated in the figures, and explained fully in the discussion of each individual game.

The term "bits" refers to word bits supplemented by individual letters; while the term "active bit" refers to a bit available for linking. Their use implies that the preferred version uses WordBits. The term "unit" refers to a bit or word that is to be linked, and its use implies that the preferred version uses either WordBits or Word Mutation. The term "supply pool" refers to the source of units from which a player can get units to link. For each game, versions are referred to as "1A", "1B", or the like, and the preferred or illustrative format is the primary version "A".

In game 1 and its versions, the goal is to be the first to link bits and form words. Hence all players are active at the same time. In 1A the bits come from one's personal pool, with the player being able to exchange an unwanted bit from his pool with one from a shared supply pool, where only some bits are active at any one time. The nature of the pool differs for each of the versions and variations.

In game 2 and its versions, the goal is to form the most words. Players usually take turns or play alone. The supply pool for 2A is a personal pool of finite bits which decreases in number as words are formed. The nature of the pool differs for each version and variations.

In game 3 and its versions (all puzzles) all the units are given, and the goal is to find the correct partner for each, and make the right links to form the required number of words or to find the correct bit or word chain. The type of link is specified for each puzzle. In 3A an even number of word bits is provided and each has only one correct partner in order for the maximum number of words to be formed. For the preferred variation, the second part of the puzzle is to correctly stack the words in a configured grid to find a final word.

In game 4 and its versions, the goal is to create the correct word chain given only the ends of the chain. The type of linking is by a specified word transformation. In 4A the player uses a specially designed grid that provides built-in guides and constraints and optional aids to entering letters and words. In one variation only one end is given, but the transformation is given for each step.

In game 5 and its versions, the goal is to find the correct word bit or word chains or clusters given only descriptive clues (as in crossword puzzles) with the benefit of a configured grid and with the type of linking specified. In 5A the grid is similar to the one for 4A.

WordLinks sets of word bits and words are shown in FIGS. 1A-1C and 2. A WordBits set is shown in FIGS. 1A-1C while a Word Mutation set is illustrated in FIG. 2.

In FIG. 1A, the set of word bits includes an individual letter set 11 (the numbers on each tile indicate how many tiles of that letter are in the set). A set of two-letter word bits 12 are shown in FIG. 1B and are preferably arranged according to color group: nine groups of twenty bits each. The color of each tile serves a key role in many of the games disclosed herein. Although color is used for grouping, other grouping methods such as use of numbering, symbols, shapes, sizes, or the like may be used. A set of three-letter word bits composed of consonant pairs plus a vowel are shown in FIG. 1C. Three-letter word bits that commonly serve as the front of longer words ("heads") are shown in an upper group 13, while the three letter word bits that are commonly used in the end of longer words ("tails") are shown in a bottom group 14. Word bits with one consonant and two vowels and with three consonants are also used but not shown.

It should be noted that WordBits sets in other languages like French, Spanish, Pilipino, or the like may be used so that the games described here can be played in other languages, using the appropriate WordBits set.

FIG. 2 shows a subset 21 of four-letter words contained in a Word Mutation set. These words are used for games or variations involving word transformation linking. They are preferably grouped in color groups for scoring purposes; but the colors of the letters (specifically the vowels) are associated with pronunciation of the vowel or vowel pair (digraph). The phonetic symbol for the sound may be used in addition to or instead of the color code.

Types of Linking

The goal of all the games is to link words or word bits; but there are many ways by which these units can be linked. Below is a chart of the different types of linking for word bits. The three types of links for word bits (single letter change, word formation, and word assembly), the requirements for each, and examples are given. The difference between word formation and word assembly is that word formation is confined to linking two bits, while in word assembly more than two bits may be used in a forming a word.

LINKING WORD BITS

| Type of Link | Requirement for link | EXAMPLES Word bits | | Result |
|---|---|---|---|---|
| Single letter change | Linked word bits of the same length must differ by a letter in the same position | NO<br>TRA | NE<br>THA | O and E differ<br>R and H differ |
| Word formation | Two linked word bits must form a valid word. The bits do not have to have the same number of letters. | A<br>LD<br>CA<br>ICK | N<br>O<br>RD<br>TR | A-N<br>O-LD<br>CA-RD<br>TR-ICK |
| Word Assembly | Two or more linked word bits must form a valid word. The bits do not have to have the same number of letters. | MA C GI<br>EAD M SL I | | MA-GI-C<br>M-I-SL-EAD |

The types of linking for words are shown in the chart below. The six common types of mutation links for words are shown (single letter change, double letter change, single letter addition, double letter addition, single letter removal, and double letter removal); and the seventh type is for advanced players (triple letter change). Examples and explanations are given to demonstrate each transformation that links the pair of words given.

LINKING WORDS

| Type of Link | Requirement for link | EXAMPLES Word 1 | | Word 2 | Explanation |
|---|---|---|---|---|---|
| Single letter change | Linked words must differ by one letter in the same position | SING | to | SONG | I and O differ |
| | | BRAIN | to | BRAWN | I and W differ |
| Double letter change | Linked words must differ by two letters in the same positions | KING | to | MINT | K-G and M-T differ |
| | | PLUMBER | to | PLUNGER | MB and NG differ |
| Single letter addition | Linked words must differ by one added letter, with rearrangement possible | PAIN | to | PANIC | C added w/ rearrangement |
| | | HOT | to | SHOT | S added w/o rearrangement |
| Double letter addition | Linked words must differ by two added letters, with rearrangement possible | SIN | to | SAINT | A and T added w/o rearrangement |
| | | PRIDE | to | DESPAIR | S and A added w/ rearrangement |
| Single letter removal | Linked words must differ by one removed letter, with rearrangement possible | SHE | to | HE | S removed w/o rearrangement |
| | | PARADISE | to | DESPAIR | A removed w/ rearrangement |
| Double letter removal | Linked words must differ by two removed letters, with rearrangement possible | APPLE | to | PEA | P and L removed w/ rearrangement |
| | | TWIST | to | WIT | T and S removed w/o rearrangement |
| Triple letter change | Linked words must differ by three letters in the same positions | CHARITY | to | CHARADE | ITY and ADE differ |
| | | BROWN | to | GREEN | B-OW and G-EE differ |

Linking Configurations

The goal of all the games is to make links, but each specific game or version specifies the linking configurations—what units are linked, how many units are used and how they are arranged. FIGS. 3A-3C demonstrate how linking word bits or words can lead to three different configurations: (1) pairs 31 and 32, (2) simple chains 33 and 34, or (3) clusters 35 and 36, which are highly branched chains with units linking to multiple adjacent units. The examples include linked word bits and linked words.

The diagram of each example shows the words that are being formed, or the transformation that links each pair of words. In several instances where word formation is the kind of link, the orientation of one bit to the other does not affect the validity of the link. The word can be read upwards or right to left as long as the letters of the word bits are kept unchanged. This is important in chains and in clusters: note that in the word formation chain PA-GE-AR-ST 33, the ends can be even be linked (PA+ST=PAST) to form a loop.

Basic Game Pieces

Figure 4:
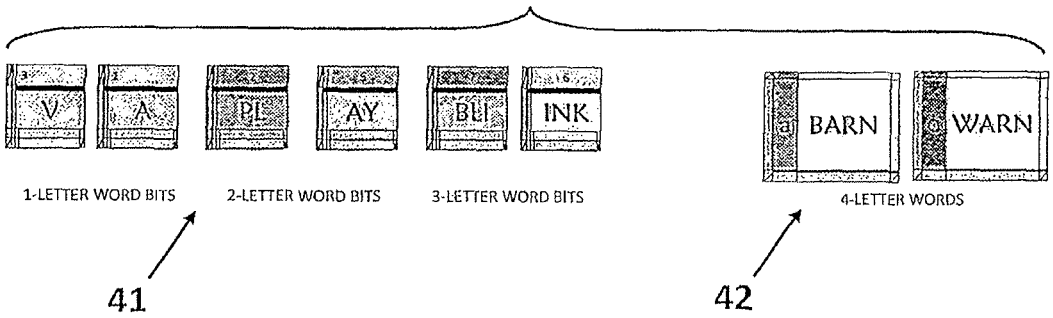
FIG. 4 is a top perspective view of word bit tiles and word tiles for use with certain preferred embodiments of the present invention.

Shown in FIG. 4 are drawings of the preferred types of tiles 41 in the WordLinks set: those with individual letters, those with two letter-word bits, those with three-letter word bits, and the preferred types of tiles 42 with words. Since the word bit tiles 41 are often used together, they are usually of the same type of tile, i.e., size and material (e.g., wood, plastic, or the like). The same is true for tiles 42. Analogous card sets containing word bits 54 and words 55, as shown in FIG. 5A, can be used but the tiles are the preferred physical form. In specific instances it is more interesting to use word bit cubes 56, as shown in FIG. 5B, of different designs and sizes that, e.g., contain 2-letter word bits on each face, 2-letter word bits on four faces and single letters on two faces, or a single letter on each face; or word cubes 57 with e.g., 3-letter or 4-letter words on each face. As described above, although the embodiments shown in FIGS. 4, 5A, and 5B are preferred, any other type of three-dimensional object may also be used as a game piece, such as tokens, die, polyhedra, spheres, or the like. The game pieces may be virtual instead of physical, e.g., in digital versions of the game for use with electronic devices.

General Rules

Because the many games and puzzles are related, it is possible to list some rules and definitions that will generally apply. Specific sets of rules for certain games or puzzles would supersede the general rules listed below.

VALID WORDS—In word formation, no capitalized, hyphenated, apostrophized, abbreviated, or vulgar words are allowed. Players should agree on which dictionary to use to resolve challenges of word validity.

EXTENDED WORDS—When playing games and puzzles with five- and/or six-letter words, a player can form what is called an "extended word." These are words assembled by simple addition of "extender" letters to the front or back of base words, without change in meaning or spelling. The common extender letters added as suffixes after the base word are S, R, N, D, Y as well as E+R, E+D, E+N. O+R, E+E, S+T, and L+Y. Those commonly added in front of the base word as a prefix include R+E, U+N, and I+N and others. For example, BOUT-S and BARE-D are extended words from BO-UT and BA-RE; and RE-HIRE and UN-WELL are extended words of HIRE and WELL. Note however that A-BOUT is not an extended word of BO-UT. Adding an R to the middle of the pair BA-ED to form BA-R-ED is valid since the root word BARE is not extended with a single letter. In some games, the extended word is disallowed, or is allowed accompanied by a point deduction per letter beyond the base word.

UNDECLARED WORDS—When forming five- and six-letter words (called "fives" and "sixes," respectively) using pairs of two-letter word bits, single letter tiles may be used. However, there is a variation to this using blanks or spaces as "undeclared letters," such that the word formed is an "undeclared word" (either an "undeclared five" or an "undeclared six"). When a player forming a five-letter word pairs up and assembles the word bits in the correct order, he uses a blank or space to represent the fifth letter. Using the symbol # to represent the undeclared letter, CL-OW-# would represent CL-OW-N; #-LA-CE could represent PLACE; and LA-#-CE would be LANCE. In forming a six-letter word, a similar procedure is used except two undeclared letters are used. Thus #-AG-#-ON could represent LAGOON; JU-#-#-ST could represent JURIST; and OR-#-HI-# could represent ORCHID. Opposing players may challenge if they do not think that a valid word can be formed. In advanced games no blanks or spaces are used, words with the position(s) of the undeclared letter(s) unspecified to opponents. These words are called "unspecified words."

PLAYING TOGETHER WITH DIFFERENT SKILL LEVELS—Unless the object of players is simply to win, a competitive game is best for all. Therefore, when the skill levels of players are different and known (e.g., from past performance), it is desirable to level the playing field so that each player is playing equally hard and all have a chance to win. In many games a way of handicapping superior players is described: less experienced players can be given "equalizers," such as being tasked with forming fewer and/or shorter words, having more time, or being exempt from the normal restrictions and/or being immune from penalties. All this should be agreed upon before starting.

Game 1

In game 1 and its versions, the goal is to be the first to link bits and form words. Hence, all players are active at the same time. In the preferred embodiment the bits come from one's personal pool, with the player being able to exchange an unwanted bit from his pool with one from a shared supply pool, where only some bits are active at any one time. The nature of the pool differs for each of the versions and variations.

Variation 1A

The object of game 1A is to form 4-letter words by pairing word bits 61 (FIG. 6A) from their personal pool or hand. After starting, a player can change an unwanted bit in his hand with one from the supply pool which contains bits that are face up and face down, at any time and as often as he wants. He does this by placing the unwanted bit face up in the supply pool and then picking up a new bit. A player must form his target number of words ahead of the others in order to gain "win chips" 62 (FIG. 6A) which are preferably plastic chips or tokens, but may take other forms, such as cards, tiles, or the like. Each player's target number of words for a round is the number on his "skill card" 63 (which contains a number based on his skill) plus the number of chips he has won. Thus, because they need to form fewer words, less experienced players can compete; and players trailing during a game have a good chance of catching up with the leaders.

Preferably two to eight players can play. Based on performance in previous games (if known), players may be given skill cards with numbers ranging from BUNNY 1 (less experienced) to HARE 6 (highly skilled). As will be explained below, the numbers denote the initial target number of words the player is assigned to form. Players may also start on even ground by getting the same RABBIT 4 skill card. The bits are thoroughly mixed face down on a table or other playing surface. A supply pool is formed by arranging the bits in a tight circle, with an open space in the center for discards, in the middle of the table.

Players take a predetermined number of bits, preferably equal to twice the number printed on their respective skill cards, in order to form a hand for the round. For example, a BUNNY 1 player needs to only form one word, and so he takes two bits. A HARE 6 player needs six words and takes twelve bits. Players turn their bits over at the same time, arrange them, and try to create words by pairing the word bits from their hand. A player may change one bit at any time, as many times as he wants. To change a bit, a player preferably must first discard the tile face up in the discard zone in the center of the supply pool, before picking up the replacement (a face-down bit or a face-up discard). A player may not obscure the view of the discarded tiles by having hands over the area longer than needed to change tiles. Upon forming his number of target words, a player may claim points by saying "DONE." Once a player says "DONE," he may no longer touch his tiles. Preferably after two or three players have said "DONE," they check and may challenge any of each other's words. If a finisher is found to have an invalid word, he is eliminated from the round. The others continue play until they are told that all words of the first two players are valid, upon which the round ends. Preferably, the first place player gets two win chips and the second place player gets one win chip.

In a preferred embodiment, whenever a player wins in a round and gains chips, his target number of words increases for the next round. For example, a player with a skill card of RABBIT 4 and no chips has a target number of four (4+0=4). If he finishes first he wins two chips, his target number of words increases from four to six (4+2=6). A player with a skill card of BUNNY 2 with 3 chips that finishes in second place wins one chip; and his target number of words increases from five (2+3) to six (2+4). The more that a player wins, the more chips he gains so that his target number of words continues to increase. To start the next round, all tiles are returned to the supply pool and the initial set-up is repeated. Rounds are played as earlier rounds except that the target words continue to increase in number. Preferably, the player that accumulates ten win chips is the winner.

Figure 6A:
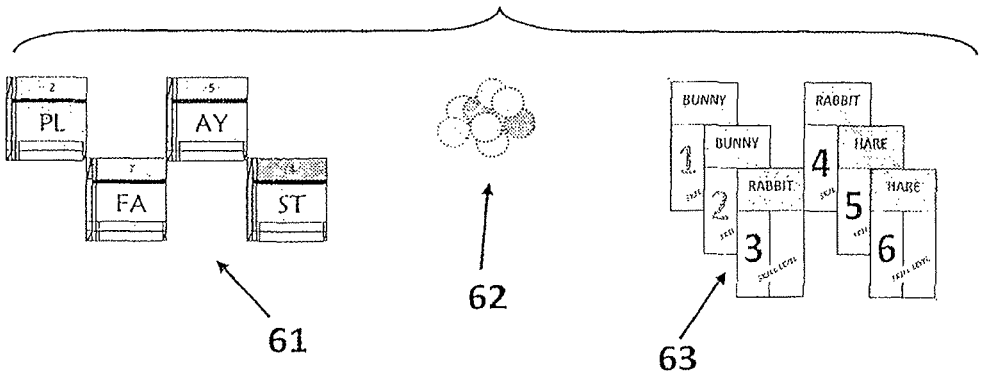
FIG. 6A is a schematic representation of game pieces in accordance with a first preferred embodiment of the present invention.
Figure 6B:
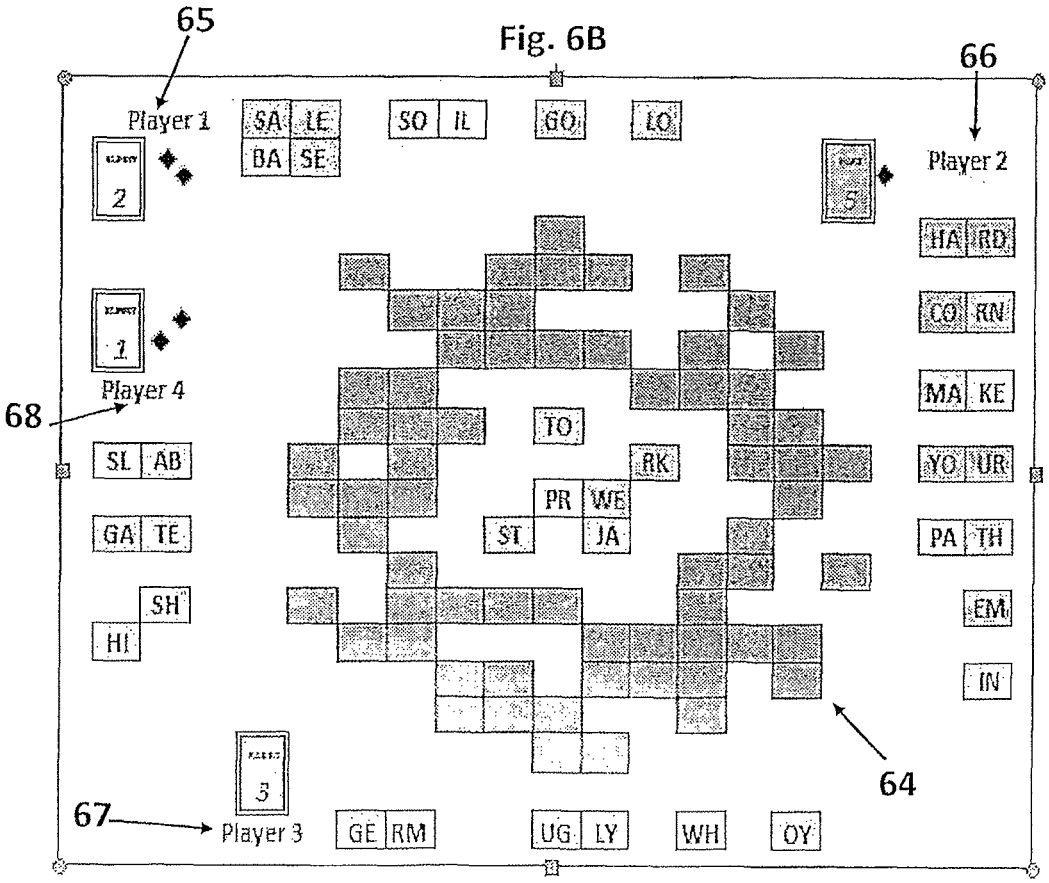
FIG. 6B is a schematic representation of a game in progress in accordance with a first preferred embodiment of the present invention.

Referring to FIG. 6A, the game pieces needed to play game 1A are shown: word bits tiles 61, win chips 62, and skill cards 63. As shown in the game illustrated in FIG. 6B, four players of different skill levels are playing. The supply pool 64 is in the middle of the table. The grey squares represent face-down tiles. The word bits TO, RK, PR, WE, ST and JA are face up in the discard zone. Player 1 65 has a BUNNY 2 skill card and 2 win chips (he needs to form 2+2=4 words to win the round). Based on their skill cards and win chips, player 2 66 needs to form 5+1=6 words; player 3 67 needs to form 3+0=3 words 66; and player 4 68 needs to form 1+2=3 words.

All players may arrange their word bits as needed and can exchange any one bit at any time, so in this scenario, any could win the round with the following plays: (1) Player 1 65 may discard GO and take ST to form LO-ST. But he can win more easily by linking his two bits to form LO-GO as his fourth word. (2) Player 2 66 can best finish by rearranging his bits. He can unlink PA-TH and then pair TH with EM to form TH-EM; and PA with IN to form PA-IN. (3) Player 3 67 cannot link either WH or OY with any open bit. His best play is to discard one and take ST; and quickly discard again and take WE to form WE-ST. (4) Player 4 68 cannot pair either SH or HI with any open bit. One option is to do as player 3 67 and compete for the open tiles WE and ST. But he can also discard HI, keeping SH, and take a closed tile. SH can link with many bits, and he hopes for a bit like AM, CA, DA, OP, or DI to pair with SH and form SH-AM, CA-SH, DA-SH, SH-OP, or DI-SH as his fourth word.

Variation 1A1

The object of game variation 1A1, which can be played with tiles, cards, cubes, or the like, is to be the one to link a word bit from one's personal pool with the one shared target word bit, revealed so that all players see it at the same time. The target bit is changed if no one claims it. Players can change the bits in their pool whenever a word is formed. The winner is the first player to form five words.

Variation 1A2

The object of game variation 1A2 is to search for and claim as many word bit tiles from the shared supply pool that can be linked to a shared target bit, revealed so that all players see it at the same time; and to be the first to form three valid words within the time limit for the round. A maximum of three tiles may be grabbed. An additional target bit is revealed if the first one produces no winner within the time limit. The winner is the first player to form 15 words.

General variations, for example with respect to changing the length of the word formed and the type of linking (e.g., from word formation to mutation), may be made without departing from the invention.

Variation 1B

Game version 1B is a highly interactive floor game for many players, who start the game confined inside a defined "enclosure." The object is to link one's word bit tile or card with another player's to form a four-letter word as quickly as possible. The couples who are first able to form words are allowed to leave the enclosure. Players without correctly linked bits are eliminated.

As many players as can fit in the room may play, including kids who can form four-letter words. An enclosure 71 large enough to hold the players is preferably created by placing highly visible game pads (more pads than players) in the perimeter of the enclosure. The enclosure may also be established based on a preexisting structure, or may be defined by outlines, physical reference points, or the like. One of the participants is assigned the role of a "gatekeeper" 73, who decides if a word is valid or not, and is positioned at a break in the enclosure 71. Enough word bits are mixed and one bit is placed, face down, on each pad.

Initially, all players go inside the enclosure and move around. When given the signal, each player picks up a word bit from a pad. Players compare their word bits with those of other players and try to form a word. A player is preferably allowed to have only one word bit at a time. If a player does not like his word bit, he may exchange it for one on a pad. The bit must be put back face down. When two players think that their bits can be linked into a word, they rush to the gatekeeper 73, show their word, and get permission to exit the enclosure 71 to the free space 72. They are allowed exit only if the word is valid. The last players left inside are eliminated from the game. The number eliminated depends on the number of players and on the game duration desired.

The same word bits or a different set may be used for different rounds. The word bits are mixed and again placed randomly on the pads. Surviving players re-enter the enclosure 71 and the round is played as before, with fewer players playing from round to round. In the last round, only four players will remain. The pair that gets out first is the winner.

Variation 1B1

Figure 7A:
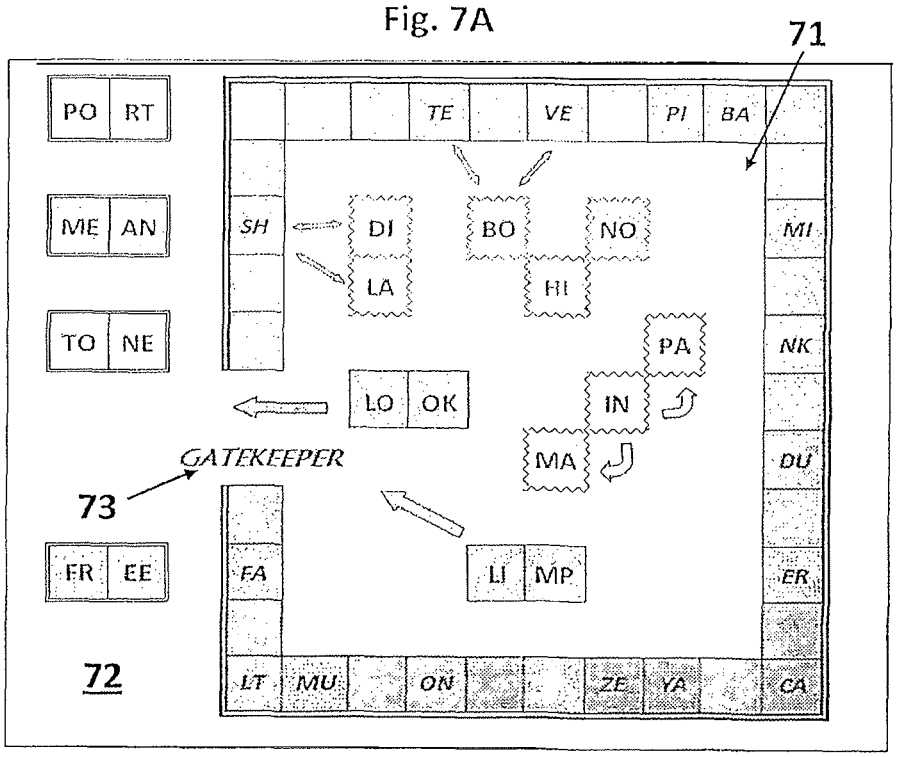
FIG. 7A is a schematic representation of a game area in accordance with a second preferred embodiment of the present invention.
Figure 7B:
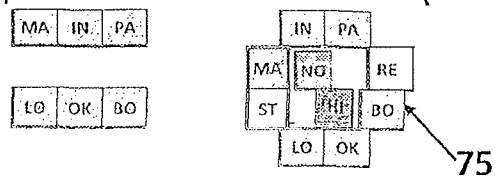
FIG. 7B is a partial schematic representation of linking variations in accordance with the second preferred embodiment of the present invention.

Referring to FIG. 7B, game variation 1B1 is played very similarly to game 1B except that four or more players must form a closed chain 75 (e.g., a loop) in order to safely exit the enclosure. Unlinked players may be "captured" by a loop that closes around them and be eliminated that way. The game ends when four surviving players remain.

General variations, for example with respect to changing the length of the word formed, and the type of linking (e.g., from word formation to letter change), and the linking configuration (e.g., chain instead of pair) may be made without departing from the invention.

Variation 1C

The object of game version 1C is to be the first to form five four-letter words lined up in a game card. Each unique game card preferably contains a 5×5 array of 25 squares, each with a word bit. On each turn, the same square (same column and row) in everyone's card is activated by a caller via dice roll. Words are formed by linking the word bit in the activated square with a word bit tile. If the player is able to find a suitable tile in his own personal supply pool or in a shared pool, the player fills the activated square by laying the word bit tile thereon. On occasion, the die roll allows the players to choose which square in a row or column to fill.

Preferably two to six players can play. Players agree on game pace (the time limit per turn). Players agree on additional or fewer active tiles per round (12 for a standard game) which changes game speed and complexity. Each player picks a game card with twenty five squares with a word bit printed on each (different for each card) in a 5×5 array. The columns are preferably labeled W, I, N, G and O; and the rows are numbered 1, 2, 3, 4, and 5. Thus, each square in a card is defined by its row and column (e.g., W-2 or G-5). A "row die" (with 1, 2, 3, 4, 5, and a "wild" on its faces) and a "column die" (with W, I, N, G, O, and "wild" on its faces) are used. A set of pattern cards may be used to increase the ways for how "WINGO" can be achieved.

To start, the word bit tiles are mixed face down. A "dealer" is chosen for the first turn. The dealer opens six randomly chosen tiles and places them on a pad. This is the common pool, available for any player to use. Each player gets six tiles from the supply pool as his hand (personal pool). Thus there are a total of 12 active tiles for each player at any time. The dealer starts the timer and rolls the row die and the column die. The top faces identify the position of the square in the cards that is active for the turn. A wild row die roll means that any square in the rolled column is active; and a wild column die roll means that any square in the rolled row is active. Two wilds rolled means that all squares are active. The dealer identifies the activated square(s) very clearly so all players can hear the call. If he can, a player finds a suitable active tile from his hand or the common pool and places it on the activated square in his card. When a wild has been rolled, players may continue to fill squares within the time allowed. Each time a player places a tile on his card, he immediately replaces it with a new tile from the inactive supply pool (placing it in his personal pool or in the common pool as appropriate). A player who gets a tile from the common pool may not return it: he must place it on the activated square. The turn ends when the 1-minute time limit is reached. Each player declares the word(s) that he has formed. Any player may challenge the validity of any word, with the winner getting to remove any tile from the loser's card. The role of dealer passes to the player to the left of the last one, and another turn is begun by repeating the above-listed steps. Before each turn a player may replace the tiles in his personal supply pool. The game ends when a player has formed valid words in five squares that are in a line horizontally, vertically, or diagonally, and declares "WINGO."

Figure 8:
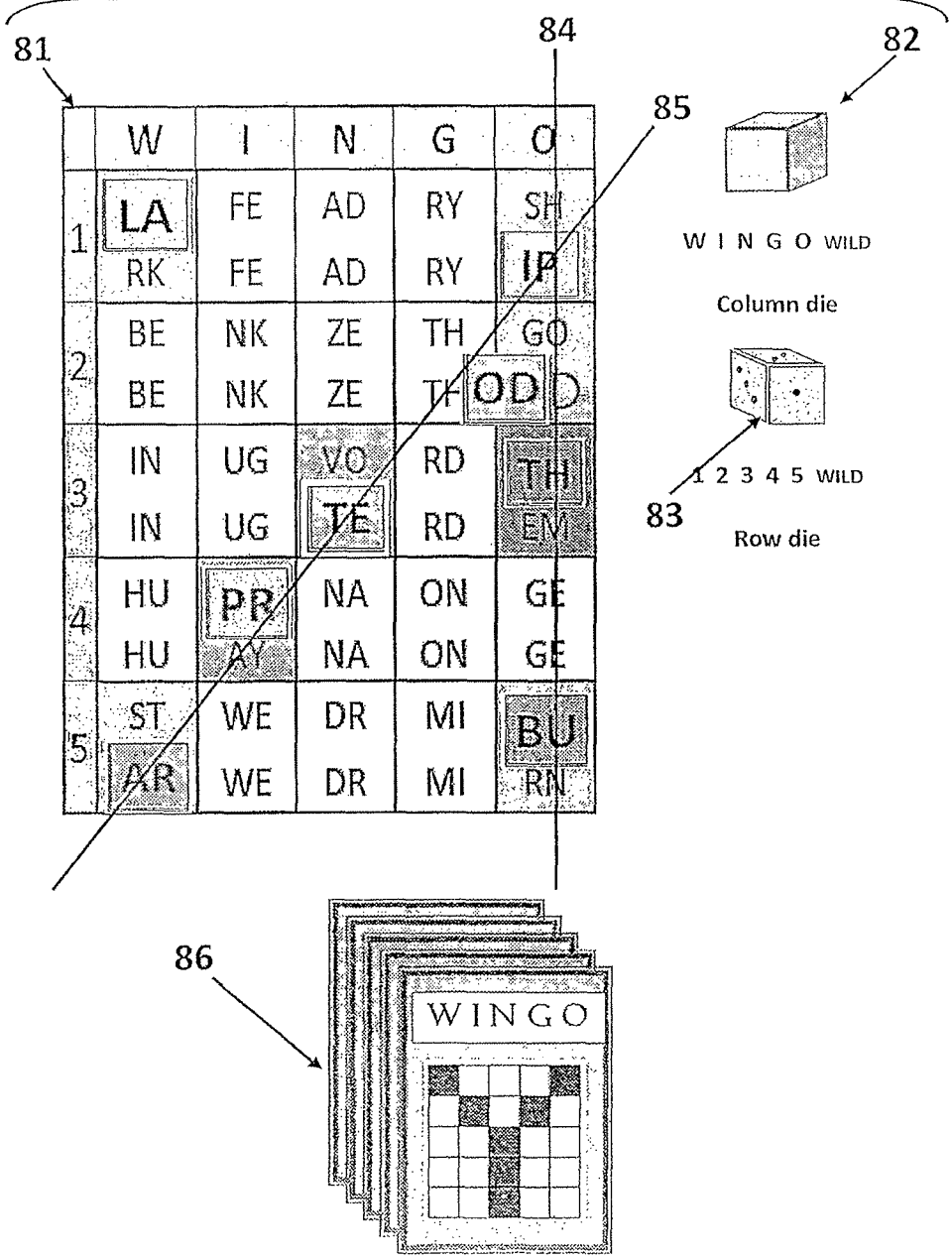
FIG. 8 is a schematic representation of game pieces for use with a third preferred embodiment of the present invention.

Referring to FIG. 8, a game version 1C is shown in progress. A partially filled game card 81 is shown. In this card design (other designs are possible) word bits are printed in the top and bottom of each square so that the word formed is visible even after laying a tile on the square. The Column Die 82 has W, I, N, G, O, and "wild" on the faces (although the faces are not marked in the drawing). The Row Die 83 can be a regular die where the rolled number determines the row (with 6="wild").

Tiles have been placed on some squares to form words (W-1=LA-RK; O-1=SH-IP; N-3=VO-TE; and the like). Since the object of the game is to fill in a line of five squares in the game card, the player can win on the next turn if he can foul a word with GE in position O-4 (filling the O column, shown by line 84) or with TH in position G-2 (completing the southwest-northeast diagonal, shown by line 85). Additional pattern cards 86 are also shown.

Other variations, for example with respect to changing the dimensions of the grid, changing the word length, using undeclared words, or changing the type of linking (e.g., from word formation to mutation), may be made without departing from the invention.

Variation 1D

The object of game version 1D is to be the first to identify and claim words of any length that can be formed by assembling two or more bits that have been revealed. The bits are revealed two at a time, and include single letters, two-letter word bits, and three-letter word bits. Players claim a word by calling it and assembling the bits in the correct order. Each word is worth the number of letters in it.

Preferably two to six players can play. Cards or cubes may be used instead of tiles. Words assembled by simple extension are not allowed. To start, the bits are mixed and one of the participants is designated as a dealer for the turn. The dealer reveals (deals) two bits at a time, in such a way that all players get to see the bits at the same time. He continues to reveal bits until a word is claimed. The first to claim bits gets to form his word. More than one player may make a claim. If the same bit is claimed simultaneously, the player forming the longer word gets the bit. A word can be challenged by any player. The winner of the challenge gets a 1-point bonus, and the loser, a 1-point penalty. When a word has been successfully claimed, the caller gathers the bits and places them in front of him. At any time a player may lengthen an existing word by adding available bit(s) to it, rearranging the bits as needed. The player takes possession of the new word if the original word belongs to another player. The turn ends when at least one word has been formed or lengthened. The dealer records the scores, giving one point per letter to each player with words. The above-described steps are repeated for each turn. Preferably, the game ends when a player has scored 20 points.

General variations, for example with respect to changing the length of the word formed and the type of linking (e.g., from word formation to mutation), may be made without departing from the invention.

Game 2

In game 2 and its versions, the goal is to form the most words. Players usually take turns or play alone. The supply pool, particularly for version 2A, is preferably a personal pool of finite bits which change in number as words are formed, any of which can be changed at any time; but which decrease in number as words are formed, all within the time allotted.

Variation 2A

The object of game 2A, a puzzle, is to form the most four-letter words by pairing two-letter word bits belonging to two or more color groups from the WordBits set. The rule is that each word must have bits of different color. Since each of the nine color groups has twenty word bits, the target number of words is ten times the number of color groups used, from twenty (for two color groups) to ninety (for all nine groups).

The four-letter words are called "Fours," and so at first the player must decide if he wants to do a Twenty Fours puzzle (using two color groups), or, for example, a Forty Fours puzzle (using four color groups). Then, the player must choose which color group combination to use. There are literally hundreds of puzzles to choose from.

The tiles from the color groups are chosen and player(s) try to form as many fours as possible, using bits of different colors to form each word. Points are preferably scored based, at least partially, on the number of words formed. For example, the solution may be scored by counting the number of words formed and crediting three points per word. If possible, an official WordBits list of valid words where each word is classified as common, uncommon, or obscure should be referenced. One point is deducted from the score for each uncommon word and two points for each obscure word to obtain the adjusted score.

For each of the puzzles, there is no unique solution and better solutions (more words, fewer uncommon and obscure words) can be found in time. A puzzle is completely solved when a perfect score is achieved, i.e., the target number of words is met and all the words are common words. For Twenty Fours, no 20-word solution to any puzzle is known at this time; but at least 15 words are possible for all puzzles. Few 30-word solutions are known at this time but many 29- and 28-word solutions exist. Many 40-word solutions are known for the Forty Fours puzzles, but some only have 39- and 38-word solutions at this time. For the larger puzzles, solutions with the maximum number of words (50, 60, 70, 80, and 90) are common, but these can always be improved by decreasing the number of less common and obscure words.

FIG. 9A shows an example of a Forty Fours puzzle 91 and FIG. 9B shows a possible solution 92. Note that each word consists of bits from different color groups 93, which for purposes of illustration are denoted by group number. The particular solution 92 in FIG. 9B can still be improved since three uncommon words have reduced the score from the perfect 120 points to 117 points.

Variation 2A1

Game variation 2A1 is a similar puzzle as game 2A, except that using the same color group combination and pairing word bits to form four-letter words, five-letter words are formed by adding one individual or undeclared letter to the two two-letter word bits. Extended words are preferably allowed. As with game 2A, the puzzle solution is scored according to the number of words formed (3 points per word), but it is adjusted by deducting 1 point for each extended word and by adding 1 point for words where the word bits are separated.

Variation 2A2

Game variation 2A2 is a similar puzzle as game 2A, except that using the same color group combination and pairing word bits to form four-letter words, six-letter words are formed by adding two individual or undeclared letter to the two two-letter word bits. Extended words are allowed. As with game 2A, the puzzle solution is scored according to the number of words formed (3 points per word), but it is adjusted by deducting 1 point for each extender letter and by adding 1 point for each space between the word bits.

Variation 2B

The object of game version 2B is to form the most four-letter words by pairing word bits located in the lower and upper parts of a preferably gridded 10×10 board. The game starts with word bits in the bottom and top rows. The player tries to create space in the board by forming words and removing the paired tiles. On regular time intervals, a row of ten new word bits is pushed into the top row of the board. All tiles at the top part of the board are thus pushed to the next lower row, decreasing the space in the middle of the board. On regular preferably larger time intervals, the active tiles from the top of the board are slid down to the bottom part, drastically changing the pool of active word bits. The game ends when tiles in a column can no longer be pushed down, or the time limit (if any) expires. The score is based on the number of words formed.

Preferably two to four players can play, and each must have his own board. The word bit tiles are mixed face down and arranged in rows of ten on the table. The supply pool is divided such that each player has the same number of supply pool rows above the active area of his board. Players take turns as timekeeper, or ask a non-player to play the role. The default time intervals to use are preferably two and six minutes, respectively, although alternative time intervals may be agreed upon by the players.

Each player takes three rows from the supply pool and places one row in each of rows 2, 5, and 8 of the board. The timer is started, following which all tiles are to be turned over. The bottom twenty tiles are slid down to rows 1 and 2, and the other ten tiles are slid up to row 10. Players then start linking active tiles to make words. Active tiles are the tiles that have an empty square above or below them. Initially, all the active tiles are the ones in rows 2 and 10. When an active tile is removed, the tile immediately below or above it in a column becomes active. The timekeeper says "add" after two minutes, and each player quickly takes a row of ten fresh tiles from the supply pool, and slides the tiles into row 10. All tiles in the upper part of the board are pushed down to the next lower row. Players continue forming words until the timekeeper says "check" after preferably 6 minutes. At this point, play is paused. The words formed are examined, and any player can challenge any other player's word. The winner of the challenge gets to place two tiles from the back of the loser's supply pool anywhere on the loser's board. After all challenges (if any) have been resolved, the timekeeper says "drop and add." Each player slides the lowest tile in each column from the top part of his board down to the bottom part, changing the active tiles. He then pushes ten fresh tiles in row 10. The game ends for each player when bits in a column can no longer be pushed down, or the supply pool is exhausted. The winner is the player with the most words.

Figure 10:
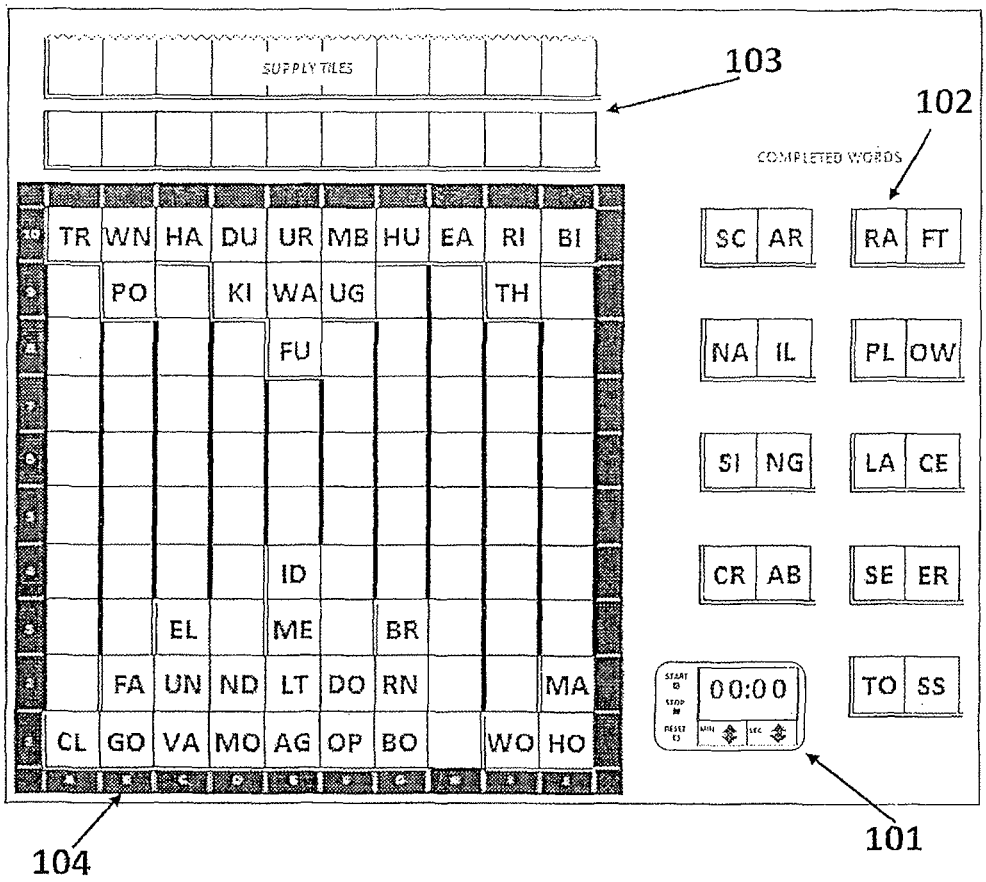
FIG. 10 is a schematic representation of a game board and pieces for use with a fifth preferred embodiment of the present invention.

FIG. 10 shows a game of version 2B in mid-play. Preferably, the materials needed are a timer 101, the word bit tiles, and the game board 104. The board 104 is shown with the supply tiles 103 on top. On the right are shown words 102 that have been formed by pairing active tiles and taking them off the board 104. The game is at the stage just before the second "add," where a row of ten tiles from the supply tiles 103 are about to be slid into row 10. The tiles at the top of the board 104 are being pushed down one row.

Play can continue in this manner: The active tiles at the top of the board are the ones with spaces below such as TR, PO, CR, and KI. The active tiles at the bottom of the board are the ones with spaces above such as CL, FA, EL, and ND. Some columns only have two or three tiles while others have more, particularly column E with seven tiles. Since there are only three spaces left in column E, the player should focus on word bits FU and ID. The tile FU can be removed by linking it with ND in column D to form FU-ND; while the tile ID can be removed by linking it with MA in column J to form MA-ID. Removing ID makes ME, below it, active. It can be linked with FA in column B to form FA-ME.

General variations, for example with respect to changing the length of the word formed and the type of linking (e.g., from word formation to mutation), or playing the game as a computer application, may be made without departing from the invention.

Variation 2C

The object of game version 2C is to link word tiles from one's personal supply pool and to create a chain ("train") with the most tiles based on the letter change transformation specified (one- or two-letter change). The winner is the first to use up all the tiles in his supply pool, or the one with the longest train at the end of the time limit.

Teams may be formed, if desired, and a time limit should be agreed upon (e.g., 5 minutes). Less experienced players may be given a head start. The tiles are mixed face down and distributed evenly amongst the players as their supply pools. Extra bits are set aside. A timer should be assigned.

To start a game, each player picks a starting tile from his supply pool and gives it to the player to his left, who places it face up in front of him. The timer is started, and each player turns over all his tiles. He starts building his train by getting a tile from his supply pool and linking it to his starter tile. To lengthen the train, more tiles can be added by linking a word to the word in either end of the train or by inserting a word between two words in the train. Any two adjacent words must differ by one or two letters in the same position. Links can be made to the side, top, or bottom of a tile so that the train can turn in order to fit on the table.

The game ends when the time limit is reached. Players examine each other's trains to find any invalid links. If it is discovered that a train has an invalid link, the chain is separated at that point, and only the longer segment counts for the score. One point is scored for each tile in the train. The player/team with the highest score is the winner.

Variation 2C1

Game variation 2C1 is played just like game version 2C except that the linking configuration is not a chain but pairs of tiles; and the supply pool is first arranged into a pyramidal stack of specified design, and only tiles that can be slid out may be used.

General variations, for example with respect to changing the linking configuration (e.g., from chains to pairs), the type of linking (e.g., from mutation to word formation), or the length of the word (for word formation), may be made without departing from the invention.

Variation 2D

The object of game version 2D is similar to "SCRABBLE" but it is better in that it offers more possibilities for linking tiles, and it challenges one's analytical and pattern recognition skills more. The critical improvement is in the tiles used, which include not only letters but also word bits. Also, new words can be created in any of the four directions. Each tile has a point value which is added to the score for each new word to which it contributes. The game board has special squares which increase the score of the word bit or the word.

Preferably two to four players can play. A time limit may be imposed per turn. Players usually receive seven tiles per turn, but less experienced players can be given the "equalizer" of having more tiles and/or more time. The two-letter word bits and individual letter tiles are preferably placed in a bag and mixed well.

After determining which player goes first, turns go in a clockwise direction. Each player gets seven tiles from the bag. The first player puts down a chain of tiles across the center square of the board in one row or column, such that each tile is part of at least one word as read in both directions. Capitalized, hyphenated, apostrophized, abbreviated, and vulgar or offensive words are preferably disallowed.

A player obtains a score according to the following: (i) The point value for a word bit tile is equal to its group number (1 to 9). The individual letter tiles have point values as follows: A, D, E, I, L, N, O, R, S, T, and U have a 1-point value; B, C, F, G, FL M, P, W, and Y have a 2-point value; J, K, V, X, and Z have a 3-point value; and Q has a 4-point value. Blanks (wilds) have point values from 0 (a letter blank) to 9 points (the group 9 wild). (ii) Each bit is scored for each new word it contributes to forming, read in any direction. (iii) A tile that is placed on a "double bit" or "triple bit" square is scored twice or thrice its face value, respectively. (iv) A tile being placed on a "double word" or "triple word" square will result in the word score being doubled or trebled, respectively. (v) Each new word made by each bit as read in all four directions is scored by adding the scores of the member bits. (vi) Any new word is scored only once, and only one word can be claimed in any one direction in each row or column. The player replaces the tiles that he used with tiles from the supply bag, and the turn goes to the next player.

For all succeeding turns, at least one of the tiles laid down must touch a tile already on the board, all the tiles must be placed in the same column or row and cannot be separated by empty squares, and each new tile must be part of a new word with any other tile that it touches. A bit can be part of as many as four new words, one (and only one) in each direction (left to right, right to left, top to bottom, and/or bottom to top). The player must declare each new word that he is forming, specifying which new and pre-existing bits are being used. A player's score is the sum of the scores for all new words he has formed.

The validity of any word can be challenged, and the challenged player has the option to accept the challenge or withdraw the tile(s). Challenges are resolved using a dictionary. Preferably, the winner gets a 10-point bonus and the loser gets a 10-point penalty and also loses all points resulting from the invalidly placed tile(s). During a turn, instead of laying tiles on the board, a player has the option to pass or to swap tiles with tiles in the supply pool. The game ends when all players in succession are unable to lay down a tile. The winner is the player with the highest score.

Figure 11A:
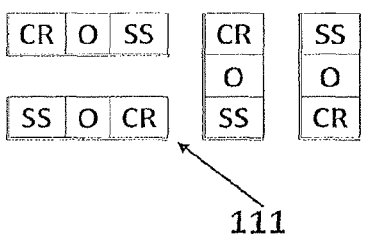
FIG. 11A is a schematic representation of possible arrangement of tiles in accordance with a sixth preferred embodiment of the present invention.
Figure 11B:
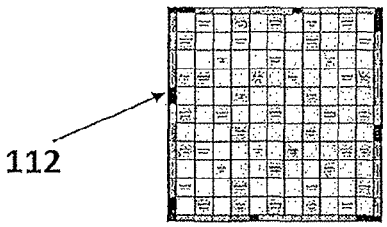
FIG. 11B is a top plan view of a game board for use with the sixth preferred embodiment of the present invention.

FIG. 11A shows an example of how tiles may be placed down from turn to turn. As shown with the example 111 CR-O-SS, a word may be created as long as it can be read in any of the four directions. An example of a game board 112 is shown in FIG. 11B. The four kinds of special squares, each having its own color, are symmetrically distributed.

Figure 11C:
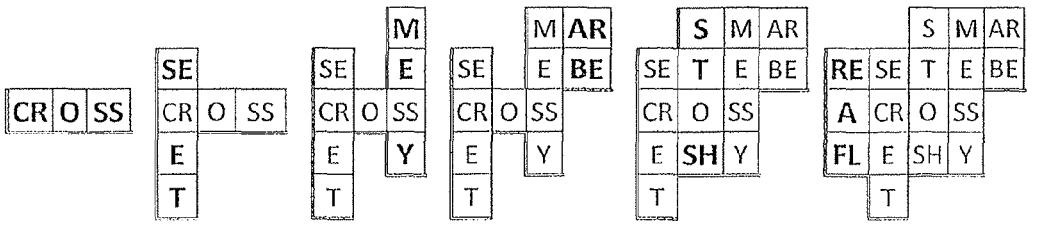
FIG. 11C is a schematic representation of multiple turns of a game in accordance with the sixth embodiment of the present invention.

In FIG. 11C, an exemplary turn-by-turn illustration of the game is shown. The colors and point values of each bit and where they are placed on the board are not shown for simplicity. For each turn, the tiles that are placed down are shown with bolded letters, such as turn 1 where all tiles of CR-O-SS, and then turn 2 where the SE, E, and T of SE-CR-E-T are bolded. The tables below the tiles list the bits that have been added for each turn, and the new words that each has contributed to forming in all four directions, which in turns 1 and 2 constitute just one word, which is only scored once. But in turn 3, the bit E has contributed to the word M-E-SS-Y from top to bottom, and to the word E-M from bottom to top. A similar case is seen in turn 4, where AR is part of M-AR going from left to right; AR-M going from right to left; and BE-AR going from bottom to top. In turn 5 for the bit T and turn 6 for the word bit RE, an important rule is illustrated: when a bit forms a word in one direction, bits beyond the used bits may be ignored. When the word SE-T is formed, the E and the BE in the same direction in the row, although contiguous, may be ignored. Similarly, for the word BE-E-T from right to left, SE is ignored. In turn 6, for RE-SE-T, E and BE are ignored.

Variation 2D1

Game variation 2D1 is played just like game version 2D except that no board is used. The tiles are placed on a table. A player's score during a turn is the total of the face values of tiles used in all the new words that he has formed. The game ends after each player has had ten turns.

Variation 2D2

Game variation 2D2 is played just like game version 2D except that the object is to be the one to put down the most tiles, using word formation or single letter replacement linking. A player starts with seven tiles as with game version 2D, and this pool is replenished after every turn. The tiles are placed on a table as in game variation 2D1, except that a new bit can be linked to any bit already on the table, as long as it forms a valid link with every pre-existing bit it touches. A player's score during a turn is the number of tiles that he has put down. The game ends after a player has scored 30 points.

Variation 2E

The object of game version 2E is to form as many four-letter words from two-letter word bits cubes within the time allowed. A player starts by preferably rolling eight cubes, and tries to form words by pairing up cubes. He may reroll the cubes four times. When able to pair up two cubes, he sets them aside and continues play until he has formed four words. At this time he gets eight new cubes and keeps playing until time expires.

Preferably two to four players can play. Kids and less experienced players may play against better players by being given more time per turn and/or more rolls. If available, a set of cubes with four word bits and two individual letters on the faces can be used and less experienced players can be allowed to form shorter words. For advanced players, undeclared fives or sixes instead of fours may be formed.

The first player gets preferably eight word bit cubes from inside a dice bag and places them in a shaker cup. The timer is started. The first player shakes the cup and rolls the cubes on the table. The top faces are the active bits which he may pair up to form words. He may reroll any or all cubes up to four times, but he has to use the shaker cup. After forming a valid word, he sets aside the cubes and may roll any of the remaining cubes. He continues until he has paired up all cubes or time expires. If he has formed four words and still has time, he can get eight new cubes and form more words until time does expire. He declares his words and gets one win chip for each valid word formed. Any word can be challenged, with the winner of the challenge getting a win chip from the loser. For the next turn all cubes are returned to the dice bag. The next player takes his turn and plays as described above. The round ends when all players have taken a turn. The player with the most win chips after five rounds is the winner.

Figure 12A:
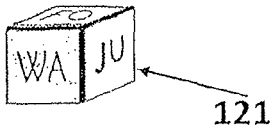
FIG. 12A is a front perspective view of a word bit cube for use with an seventh embodiment of the present invention.
Figure 12B:
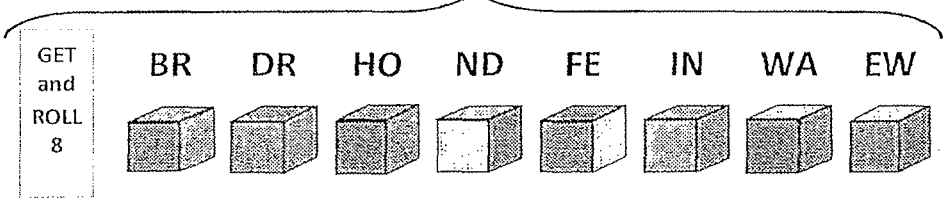
FIGS. 12B-12H are schematic representations of multiple turns of a game in accordance with the seventh embodiment of the present invention.
Figure 12C:
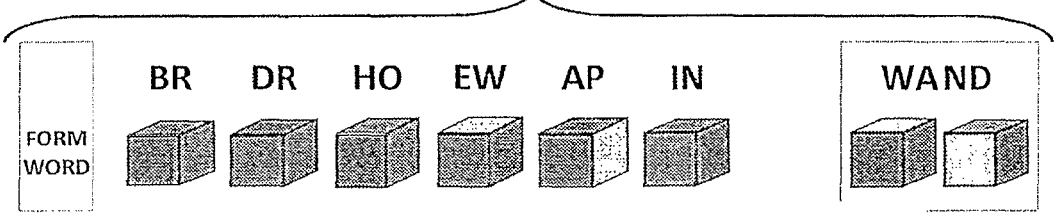
Figure 12D:
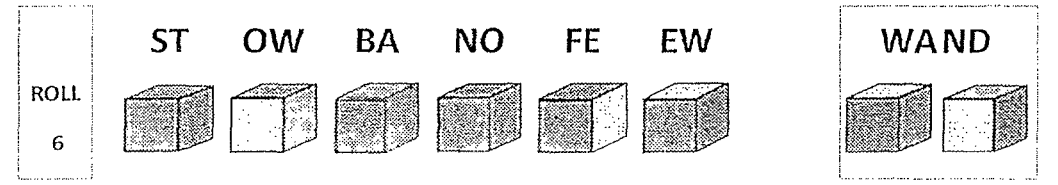
Figure 12E:
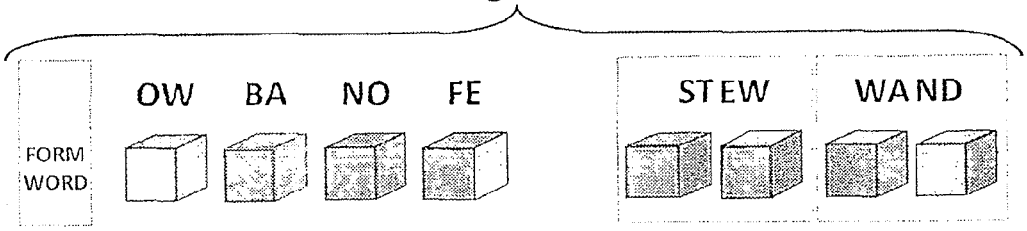
Figure 12F:
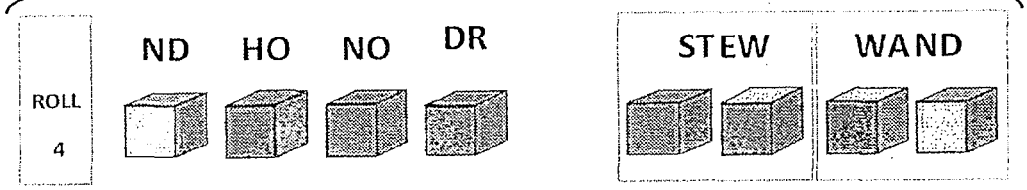
Figure 12G:
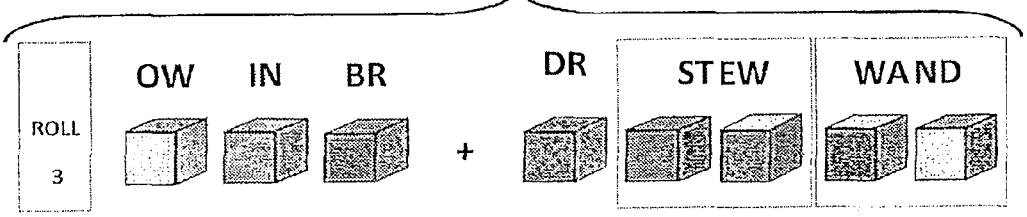
Figure 12H:
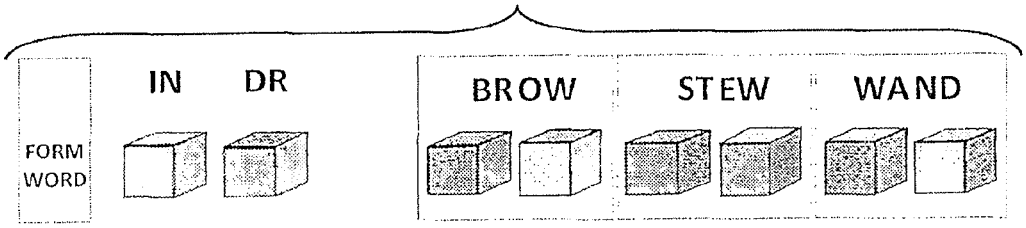

FIG. 12A shows a typical word bit cube 121. FIGS. 12B-12H show a step-by-step demonstration of how a player can form words during a turn. The different cubes are shown, but the active word bit is shown above each cube. In FIG. 12B, the player takes eight word bit cubes from the bag and rolls them. In FIG. 12C, the player is able to link two bits to one word (WA-ND), but none more. (The player fails to see the pair BR-EW.) The formed words, like WAND, are shown on the right side. In FIG. 12D. the player sets aside the two cubes and rolls the remaining six again. In FIG. 12E, the player is again able to pair two bits to one word, ST-EW, but none more. In FIG. 12F, the player rolls the remaining four cubes but can form no word. In FIG. 12G, the player keeps a cube and rerolls the other three. In FIG. 12H, the player is able to form one same-color word BR-OW 123, just before time expires. The player leaves two cubes unpaired. For the turn, the player formed three valid words (one being of one color) for 1+1+2=4 points.

Variation 2F

The object of game version 2F is to form the most words by first forming a word using letter cards that are added to the supply pool one at a time at fixed intervals (e.g., every 5 seconds) by a second player. Using the dealt letters, the player continually forms a new valid word by changing two letters at a time. The game ends when the time expires or the maximum number of cards in the supply pool is reached. Usually, four- or five-letter words are formed and continuously mutated.

At least two players should play, taking turns at being dealer/timer. If the game is played as a computer application, a player does not have to be dealer/timer. All agree on whether to have four- or five-letter words, the time interval for dealing letters, the maximum number of cards allowed in the pool, and the duration of the turn. A game board for the cards, similar to the one in FIGS. 13A-13L, is helpful.

To begin, the dealer shuffles the letter cards, turns on the timer, then opens one card preferably every 5 seconds, placing each in a slot on the game board in front of the active player. The active player forms the first word by placing the correct cards alongside each other in front of him. After this point, when he can, he takes two cards from the supply pool and covers two letters of the current word, to mutate it to a new word. He is in fact creating a word chain linked by double letter change. The dealer records each word that the player forms. The player continues playing until the limit of 12 open cards has accumulated in the pool, or five minutes have elapsed. The words are reviewed and any can be challenged by any player. The winner of the challenge gets a 1-point bonus, while the loser gets a 1-point penalty. All valid words are worth one point. After each player has taken three turns at playing, the scores are added and the player with the highest total wins.

Figures 13A, 13B, 13C, 13D, 13E, 13F, 13G, 13H, 13I, 13J, 13K, 13L:
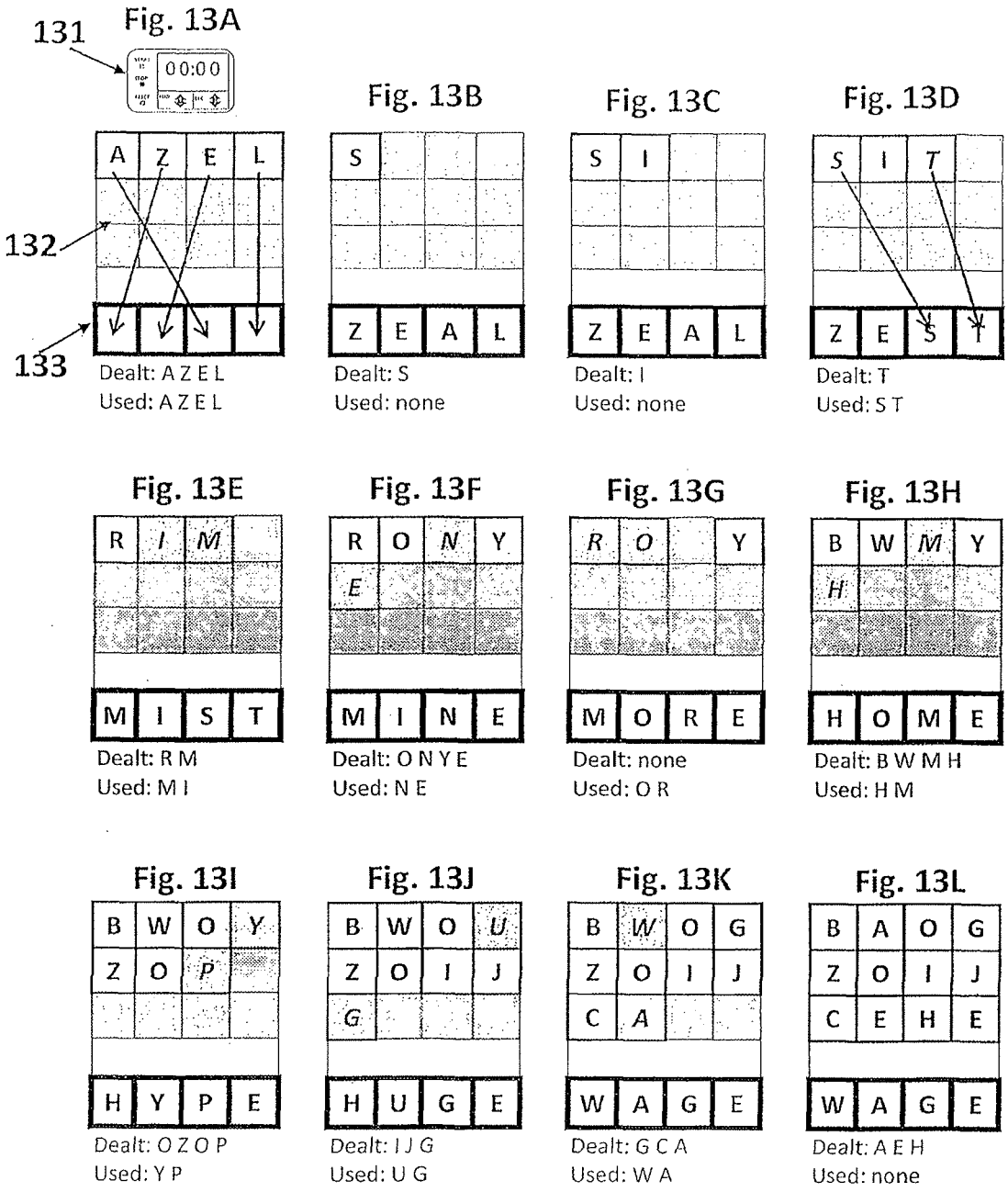
FIGS. 13A-13L are schematic representation of multiple turns of a game in accordance with a eighth embodiment of the present invention.

FIGS. 13A-13L illustrate and example of game version 2F (in Double Mutation mode) played from start to finish. The supply zone 132 is shown above squares 133 where the player forms and mutates words. A timer 131 is shown in FIG. 13A only. Twelve stages of the game are shown in FIGS. 13A-13L. After the timer 131 is started, the dealer places four cards (the letter cards A, Z, E, and L) onto four of the supply pool 132 slots (FIG. 13A). The player forms ZEAL as his first word (FIG. 13B). After the first four letters, one card is dealt preferably every 10 seconds, such as S, I and T (FIGS. 13B-13D). When the player can, he takes two cards and uses them to change the word to a new one. In his first mutation, he places S and T on top on A and L, respectively, to change ZEAL to ZEST (FIG. 13D). The dealer continues dealing one card per ten seconds, while the player continues to make new words (MIST and MINE) (FIGS. 13E-13F). Sometimes, the player can form a new word without additional cards being dealt (FIG. 13G). The game continues in this way (FIGS. 13H-13K), and ends when the maximum allowed cards (12 in this example) accumulate in the pool 132 (FIG. 13L), or time expires. In this example the player has created the word chain ZEAL-ZEST-MIST-MINE-MORE-HOME-HYPE-HUGE-WAGE for 9 points.

Variation 2F1

Game variation 2F1 is played with one, two, or three separate words at a time, each being mutated differently on separate game boards placed alongside each other. The letter pools of the game boards are treated as one single pool so that a letter from one board can be placed on a word on a different board.

Variation 2G

The object of game version 2G is to think of the most words that can be linked to a parent word by the word transformation specified by a die roll. The parent word comes from a word deck and is usually five or six letters long, and the transformations possible are one- or two-letter change, addition, or removal. Each word is worth one point, but words that are exclusively declared by a player are worth two points.

To start, each player is provided with dry erasable cards and a pen. Players take turns being dealer and roller. The role of scorer and timer also rotates around. The dealer shuffles the parent word deck, then turns one of the cards over to reveal the parent word. He then rolls the transformation cube, which has each of the six possible transformations on its faces. The timer is started as the transformation to use is revealed. Within the time allowed, players write one word on each card that satisfies the linking requirement. All stop writing when time expires, and the players present their cards to the scorer. Extended words are preferably not allowed. Each valid word is worth one point if it is declared by more than one player. A word formed by only one player is worth two points. The game ends after 10 parent words have been played. The player with the most points wins.

Figure 14A:
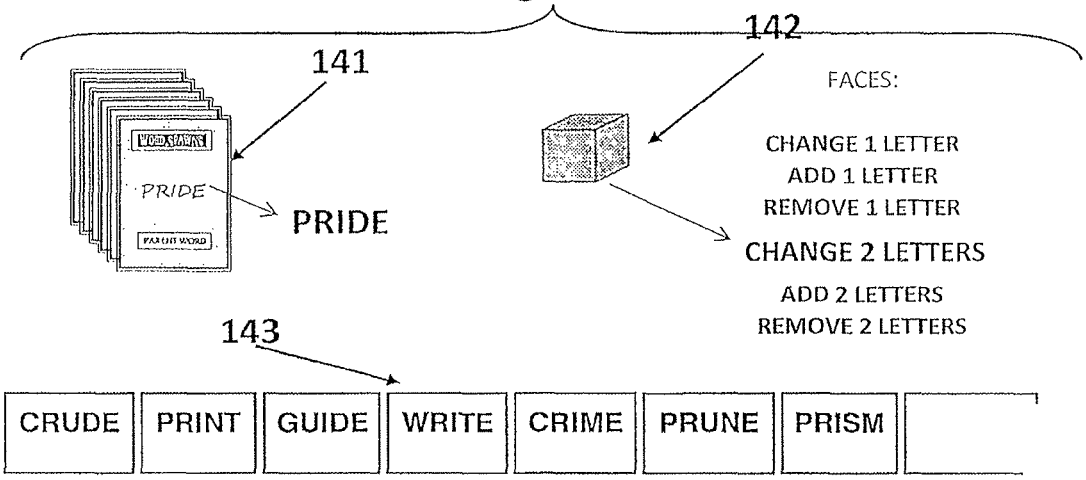
FIG. 14A is a schematic representation of game pieces for use with a ninth embodiment of the present invention.

FIG. 14A shows some of the preferred implements for playing version 2G, including a parent word deck 141, with the top card overturned to reveal the parent word PRIDE. A transformation cube 142 has been rolled to show "Change two letters." One's players set of dry-erase cards 143 are shown, with seven valid words having been formed that differ from the parent word PRIDE by two letters.

Variation 2G1

Game variation 2G1 uses the same parent word card deck as game version 2G, but the object is to be the first to write down six words, each being linked to the parent word by a different transformation. Extended words are preferably not allowed. A complete set of six is worth 10 points. An incomplete set is worth one point per word. The game ends after 10 parent words have been played, and the winner is the player with the most points.

Variation 2H

The object of game version 2H is to create the most words of a specified length by adding letters to the front of, around, or behind a word bit "seed." The length of the words to create and the part of the new word that the seed is in are determined by the roll of special dice.

Preferably two to six people can play. Players take turns being dealer/roller, timer, and scorer. Each player is provided with dry erasable cards and pen. The "word part" cube has "head," "body," and "tail" twice (on opposite faces) on the cube, while the "word length" cube has "four," "five," and "six" twice (on opposite faces) on that cube. The dealer/roller picks a word bit tile or rolls a word bit cube to reveal the word bit "seed" around which new words will be created. He then rolls both the word part cube and word length cube. If the word part is shown to be "head," the word bit is at the beginning of the new word, "body" means the word bit is inside the new word, and "tail" means it is at the end of the new word. The timer is started and all players try to create and write down as many words as they can that meet the criteria. In this game extended words are allowed.

When time is up (usually 2 minutes), all word cards are shown to for scoring. Any word can be challenged, and if accepted the winner gets one word from the loser. Each valid word is worth the number of letters in it. The next round is played just as the first, with players rotating in their roles. The game ends after ten rounds, and the player with the highest score is the winner.

Figure 14B:
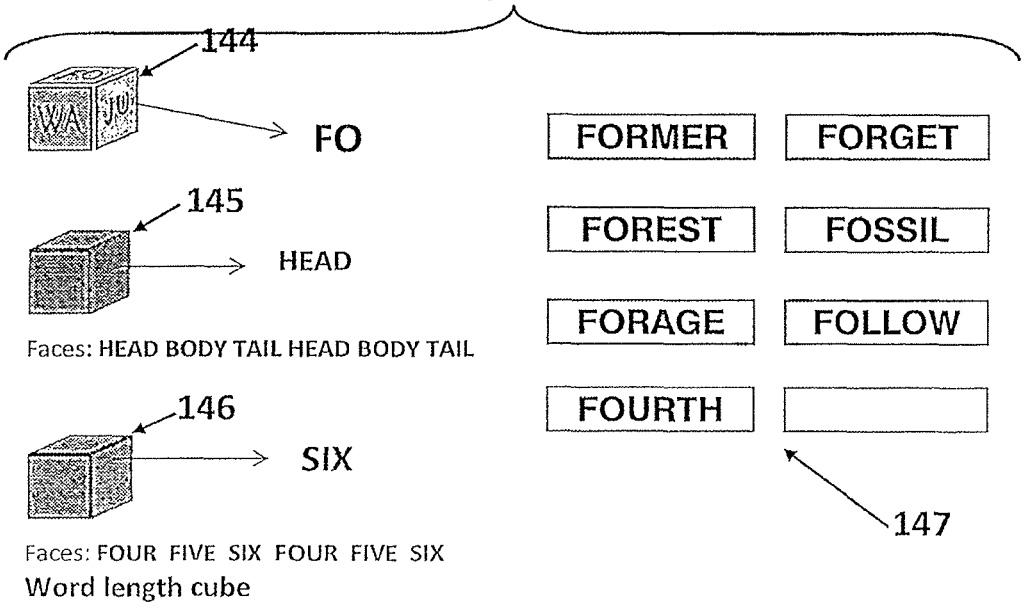
FIG. 14B is a schematic representation of game pieces for use with an tenth embodiment of the present invention.

FIG. 14B shows the word bit FO being chosen from a word bit die 144. The word part die 145 has been rolled as "head" 145 and the word length die 146 has been rolled as a "six." Player cards 147 are shown on which words that contain FO in the beginning and are six letters long have been written. The player has scored 42 points (6×7) under the scoring system described above.

Variation 2H1

Game variation 2H1 is played just like game version 2H except that the object is to be among the first to call out words that satisfy the word grow criteria. The first three words are scored. No timer is used and words are spoken rather than written.

Game 3

In game 3 and its versions (all puzzles) all the units are given, and the goal is to find the correct partner for each, and make the right links to form the required number of words or to find the correct bit or word train. The type of link is specified for each puzzle. In variation 3A, for example, an even number of bits is provided and each has only one correct partner in order for the maximum number of words to be formed. For the preferred variation, the second part of the puzzle is to correctly stack the words in a configured grid to find a final word. The grid includes rows and columns that intersect to form grid sections, each of which is configured to receive an individual letter, a word bit, or the like.

Variation 3A

In each puzzle you are preferably given eight word bits in random arrangement. The object is to arrange them in the given grid such that four 4-letter words are properly stacked on top of each other, and an 8-letter word is spelled in the shaded column. Because some words in the stack may be shifted one square to the left or right, depending on which row a word is placed, its head or its tail may be the one in the shaded column.

Figure 15A:
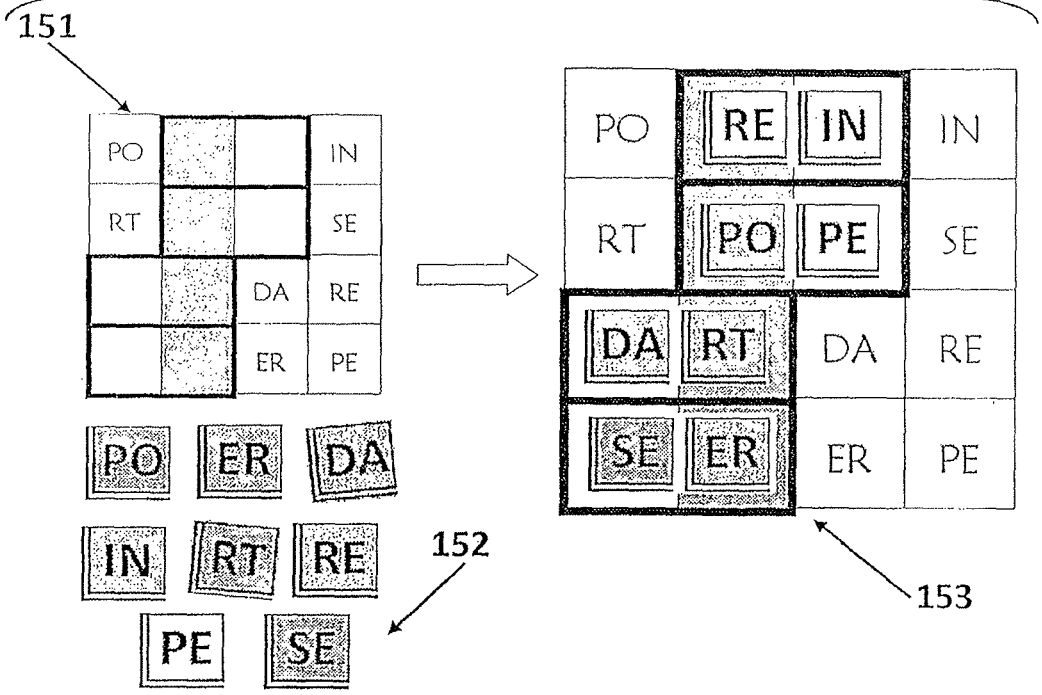
FIG. 15A is a schematic representation of a puzzle and its solution in accordance with a eleventh embodiment of the present invention.

It is easier to solve the puzzle using word bit tiles corresponding to the word bits in the puzzle. The puzzle grid 151 is shown in FIG. 15A. Only one word bit from each word is used in forming the eight-letter word. The puzzle is best solved in two steps. First, each word bit is combined with its correct partner to form four 4-letter words. All word bits must be used, and each word bit may be used only once. Second, the four words are arranged in the four heavily outlined boxes on the left such that the word bits in the shaded column spell, from top to bottom, a secret eight-letter word. These steps need not be performed in the order described to complete the game. Variations, such as placing the individual word bits in the grid 151 first, are also acceptable.

Referring again to FIG. 15A, shows the puzzle grid 151 and the word bit tiles 152 used to solve the puzzle. The solution 153 is shown to the right. Each word bit may only be paired with its correct partner in order to form four words, and these are shown to be SE-ER, DA-RT, PO-PE, and RE-IN. The correct way to arrange them in the grid 151 is shown in the solution 153, where the final eight-letter word, RE-PO-RT-ER, has been found.

Variation 3A1

Figure 15B:
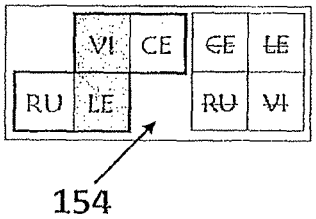
FIGS. 15B-15F are schematic representations of a grid and language variations of the eleventh embodiment of the present invention.

Game variation 3A1 puzzles are the simplest puzzles, featuring a smaller grid (see e.g., grid 154 in FIG. 15B). Four word bits are given, and two 4-letter words are arranged in two rows such that a four-letter word is formed in the shaded column.

Variation 3A2

Figure 15C:
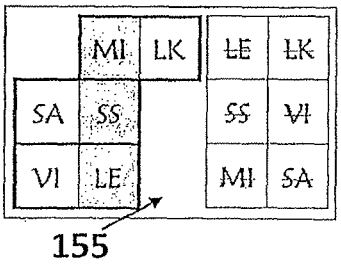

Game variation 3A2 puzzles are intermediate puzzles, featuring a medium sized grid (see e.g., grid 155 in FIG. 15C). Six word bits are given, and three 4-letter words are arranged in three rows such that a six-letter word is formed in the shaded column.

Variation 3A3

Figure 15D:
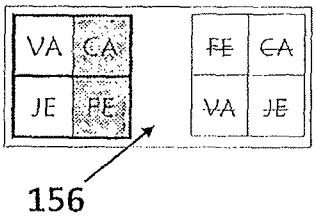

Game variation 3A3 puzzles are Spanish puzzles that are played exactly like the game 3 variations described above, and come in three sizes as well. An example is the grid 156 shown in FIG. 15D. The words in this puzzle mean "cow," "chief," and the final word is "coffee."

Variation 3A4

Figure 15E:
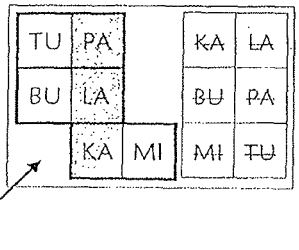

Game variation 3A4 puzzles are Pilipino puzzles that are played exactly like the game 3 variations described above, and come in three sizes as well. An example is the grid 157 shown in FIG. 15E. The words in this puzzle mean "lamb," "bubble," and "we," and the final word is "frog."

Variation 3A5

Figure 15F:
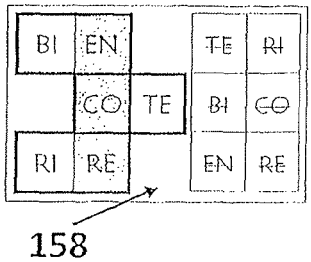

Game variation 3A5 puzzles are French puzzles that are played exactly like the game 3 variations described above, and come in three sizes as well. An example is the grid 158 shown in FIG. 15F. The words in this puzzle mean "well," "side," and "laugh," and the final word is "again."

Variations 3A3-3A5 are exemplary only, and the games described herein may be played in any language capable of reducing words to similar types of bits.

Variations such as the use of individual letters instead of word bits, the use of three-letter instead of two-letter word bits, the use of more than two bits per word, the use of grids larger than four rows, and the use of final words that differ in length from four, six, or eight letters long may be used without departing from the spirit and scope of the invention.

Variation 3B

Game version 3B includes larger puzzles than the 3A variations, but the object is simply to use all the given word bits to form the target number of words. The word bits used are all from a single color group of the WordBits two-letter set described above. Because each group preferably has twenty word bits, the target number is ten four-letter words. FIG. 16A illustrates an example using the light blue group 4 word bits 161. Each puzzle has only one solution of ten common words, and this is shown for color group 4. Subsets of a color group may also be used to create smaller and easier puzzles.

Variation 3B1

Game variation 3B1 has the same objective of using all the word bits of the color group, but instead of forming four-letter words, five-letter words are formed. This is shown in FIG. 16B. This solutions are accomplished by adding an individual letter in front of, in between, or after the two word bits 162. A valid word is worth two points; but extended words get a one-point deduction, and words with the word bits separated get a one-point bonus. Hence these puzzles have different solutions, some scoring higher than others.

Variation 3B2

Game variation 3B2 has the same objective of using all the word bits of the color group, but instead of forming four-letter words, six-letter words are formed. This is done by adding two individual letters to the two word bits 163 (see FIG. 16C). Three points are awarded per word, with a one-point deduction for each extender letter, and a one point bonus for each individual letter placed between the word bits. Hence these puzzles have different solutions, some scoring higher than others.

Variation 3C

Game version 3C is a WordLinks maze puzzle. While the typical maze is a diagram with lines, open and blocked paths, and dead-ends, the WordLinks maze puzzles that have been invented are very different in that each maze is preferably a grid of squares with a word or word bit in each square. One may move from one square to another as long as the linking requirement, as specified, is met. The difficulty of each puzzle is based on the size of the grid and on the number of forks in the possible paths. The goal of game version 3C is to find the shortest word chain that can be linked by single letter change using the words in the maze, to go from one side of the maze to the other.

The start and finish of any game version 3C are preferably two words that are a "doublet" i.e., related. The squares inside the maze are filled with words of the same length. There is preferably more than one way to get across, but some paths are longer than others.

Figure 17A:
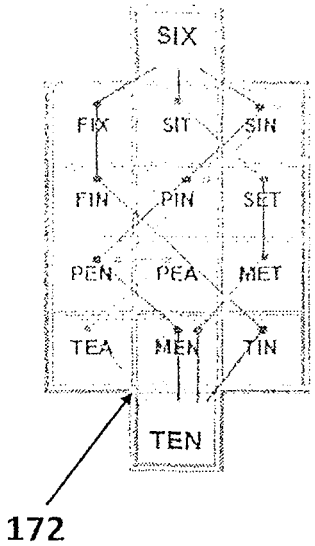
FIG. 17A is a schematic representation of a maze in accordance with a fifteenth embodiment of the present invention.

See FIG. 17A shows an exemplary maze 172. The featured maze 172 provides paths for linking the word SIX to the word TEN, using three-letter words. Larger mazes with four, five, or more-letter words are also contemplated. Starting at either word SIX or TEN, the participant moves into a word in the nearest row that differs from it by single letter change. Once inside the maze, the participant may move one or two squares horizontally, diagonally, or vertically to the next word in the word chain. The player continues to move until the farthest row is reached, then the participant can hop out to the other word. The multiple possible paths across the maze 172 are shown in FIG. 17A. The shortest chain is SIX-FIX-FIN-TIN-TEN.

Variation 3C1

Figure 17B:
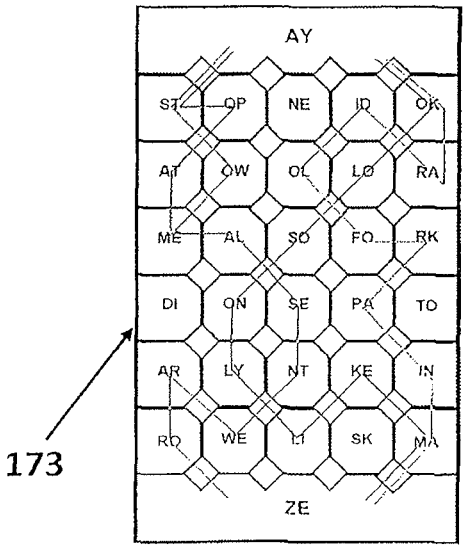
FIG. 17B is a schematic representation of a maze in accordance with a sixteenth embodiment of the present invention.

Game variation 3C1 is different in that the squares are filled with word bits, and the linking is by word formation and movement inside the maze is from one square to an immediately adjacent square only. Again there are multiple solutions for getting from one side to the other, but only one which is the shortest word bit chain. In FIG. 17B, for example, a maze 173 is shown wherein the best path includes 9 steps: AY-OK-LO-SO-ON-LY-LI-KE-MA-ZE, forming the words OKAY, LOOK, SOLO, SOON, ONLY, LILY, LIKE, MAKE, and MAZE.

Variation 3C2

Figure 17C:
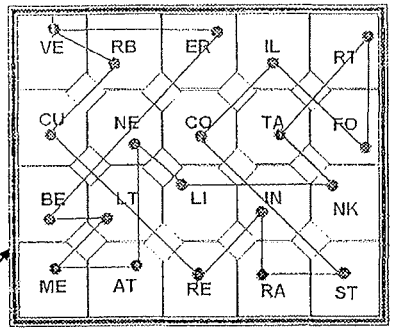
FIG. 17C is a schematic representation of a maze in accordance with a seventeenth embodiment of the present invention.

Game variation 3C2 is different from game variation 3C1 in that the maze is a closed one with no entry or exit. One may start anywhere, and the goal is to form the longest word bit loop, moving from square to square in the same way. In FIG. 17C, for example, maze 174 is a 4×5 grid with 20 word bits. The solution with the maximum 20 words being formed through the path is marked by a line, with the words formed being: VE-RB, CU-RB, CU-RE, RE-IN, RA-IN, ST-AR, CO-ST, CO-IL, FO-IL, FO-RT, TA-RT, TA-NK, LI-NK, LI-NE, NE-AT, ME-AT, ME-LT, BE-LT, BE-ER, and VE-ER. Thus the solution is a loop; but other 3C2 puzzles may have an open chain as the solution.

Variation 3C3

Figure 17D:
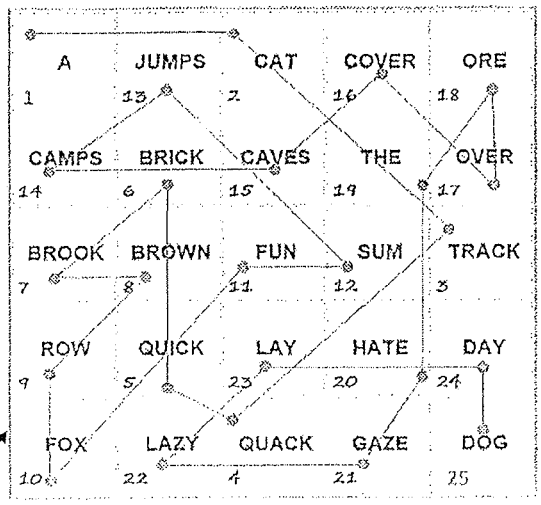
FIG. 17D is a schematic representation of a maze in accordance with a eighteenth embodiment of the present invention.

Game variation 3C3 is similar to game variation 3C2 in that the maze is a closed one and the objective is to find the longest chain. The difference is that the maze is filled with words of different lengths, and the transformation allowed to make links is any of the six operations of changing, adding, or removing one or two letters. For example, FIG. 17D shows a maze 175 with the solution marked by a line. This particular puzzle has two ends that need to be connected by an open chain, but other 3C3 mazes have loops as the solution.

Variation 3C4

Game variation 3C4 is different from game variation 3C in two ways: the linking is done by double letter change; and movement inside the maze is from one square to an immediately adjacent square only. It has the commonality of having doublets and multiple solutions, with the shortest path being the goal.

Game 4

In game 4 and its versions, the goal is to create the correct word chain given only the ends of the chain. The type of linking is by a specified word transformation. In variation 4A, for example, the player uses a specially designed grid that provides built-in guides and constraints and optional aids to entering letters and words. The grid preferably includes at least three rows and at least three columns which intersect to form grid sections, which in the figures are shown as squares. The grid is configured to receive individual letters, word bits, or the like in the each section, and a word in each row. In one variation, a starting word is provided in the first row and a different target word is formed in the last row. In another variation only one of the starting and target words is given, but details of the transformation are given for each step.

Variation 4A

The object of variation 4A, a doublets puzzle, is to find the correct word chain linked by double letter change that connects one doublet word to the other. The puzzle is presented in a special grid with aids (some built in and others for optional use) based on a specific path/chain. Using double letter change instead of single letter change and also solving the puzzle within the grid allow a player to solve even the more difficult transformations with very long path lengths.

Figure 18B:
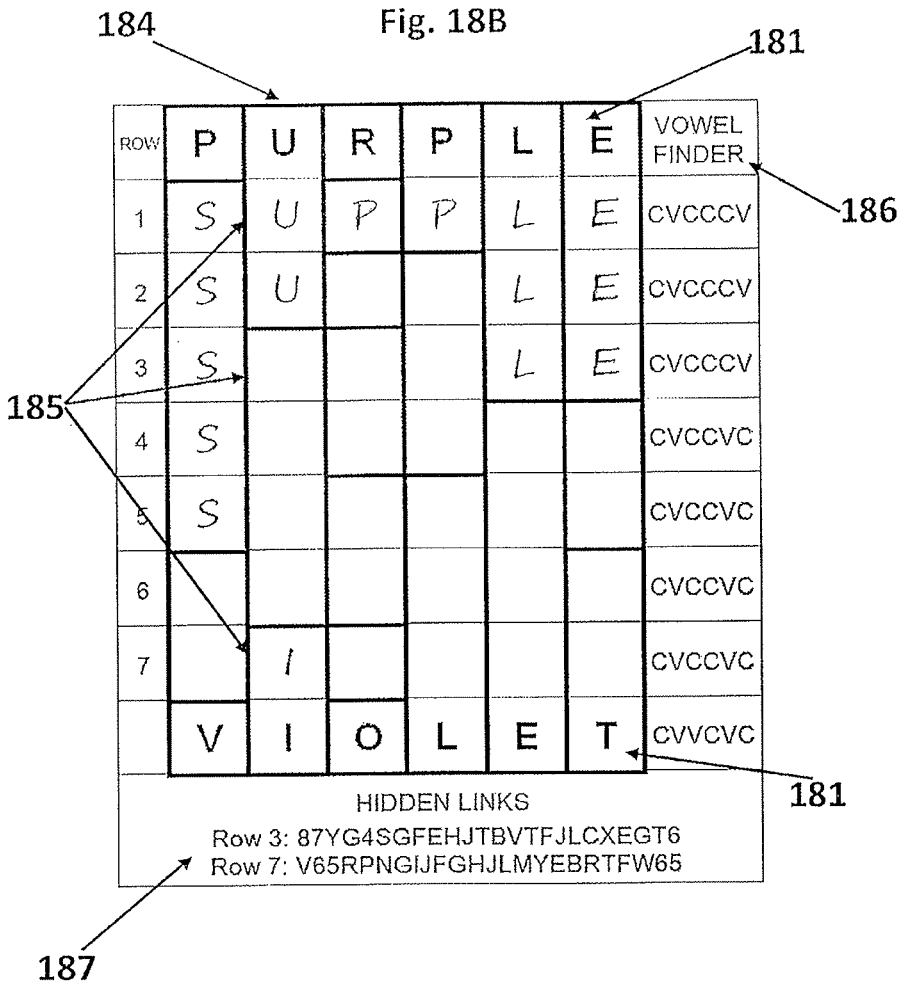
FIG. 18B is a partial solution to the puzzle of FIG. 18A.

FIGS. 18A-18C, show an exemplary puzzle, a partial solution, and the full solution. As shown in FIG. 18A, the grid 180 includes a doublet of words 181 (in this case PURPLE and VIOLET) in the first and last rows of the grid 180 that are to be connected by a word chain. The main part of the grid 180 has six columns, one for each letter of the words. A chain of seven words must be written in the seven rows 182 between PURPLE and VIOLET. This is a double letter change puzzle, so each word must differ from the word in an adjacent row by two letters in the same position, as shown in the solution 183 in FIG. 18C. The grid 180 has certain sections that will be explained below.

In FIG. 18B, one sees that each column, such as the second column 184, is composed of vertical rectangular bolded blocks 185 of one or more grid sections or squares. These blocks 185 are built-in guides called "LETTER BLOCKS" which allow the puzzle to be solved with reasonable effort. All squares in a letter block are occupied by the same letter. For the second column 184, for example, the letter blocks at the top and bottom can readily be filled in based on the knowledge of the doublets 181. The squares in rows 1 and 2, belonging to the same letter block 185 as the U from PURPLE, must also have the letter U. The same process can be used for the bottom letter block which has the letter I from VIOLET. In the diagram this is also done for the two letter blocks at the top right corner (letters L and E).

Row 1 can be filled with some certainty based on the letter pattern "_U_PLE" (knowing the first letter is not P and the third letter is not R based on the double mutation requirement). A good guess is SUPPLE (although RUMPLE is also possible). When we write the word SUPPLE across row 1, it follows that the letter block in the first column would have S in all its squares. One can continue to solve the puzzle this logical way; and one can use the optional guides in case of difficulty.

Each row may include a "VOWEL FINDER" 186 (which is one of two optional guides given to allow the player to adjust the difficulty of the puzzle to his skill level). The player has the option to use these clues or not. The vowel finder gives the consonant-vowel (C-V) pattern of the word being sought. The guess for row 1, SUPPLE, is consistent with the pattern CVCCCV given.

The other optional guide, the "HIDDEN LINKS" 187, can be found at the bottom of FIG. 18B (but it may be given in each row). A hidden links guide 187 is a letter/number sequence from which the player can easily extract the letters for the row, if desired. But the word is hidden; to find it, one ignores the numbers (1 and 0 are not used), and then marks every third letter starting with the third. For example, for row 3, the clue 87YG4SGFEHJTBVTFJLCXEGT6, gives the answer "SETTLE".

Even without the help of the hidden links to get SETTLE, one finds that only seven unknown letters (i.e., seven letter blocks) remain to be figured out if we fill the letter blocks in the lower right part of the grid. After narrowing the choices for each word, and then trying a possibility out, the impact of entering one word on other words in other rows becomes apparent due to way the letter blocks work. This allows one to know whether the choice is a good one or not.

Variation 4A1

Game variation 4A1 is played the same way as variation 4A except that only one letter is changed at a time (single letter change). Normally three, four, or five-letter doublets are used.

Variation 4A2

Game variation 4A2 is played the same way as variation 4A except that three letters are changed at a time (triple letter change). Normally five, six, and seven-letter doublets are used. This variation is also good when the letter patterns of one or both of the doublets is unusual, such as in AARDVARK-ANTEATER.

Variation 4B

Game version 4B is a doublet word chain puzzle but the doublet words do not have to be of the same length. This allows the puzzle design to create interesting doublet puzzles, for example CAT-CHEETAH and ASTRONOMER-TELESCOPE. For education, puzzles with synonyms like RICH-WEALTHY, antonyms like TITANIC-TINY, associated words like CARDIAC-HEART, and examples like HAWK-RAPTOR are desirable. The linking operation is variable (one- or two-letter change, addition, or removal), just like in the maze variation 3C3.

From word to word and from row to row, the transformation does not stay the same, and so the grid used is somewhat different from variation 4A in that letter blocks are only used when a part of the word chain is all by letter change. For the other steps, the type of transformation is given and sometimes the letters affected are given also.

Variation 4B1

Variation 4B1 is played the same way as variation 4B, except that the purpose is mainly educational. Often the goal is to increase vocabulary and so only one end of the chain (the vocabulary word) is given, and the student gains the knowledge about the word when they find the other member of the doublet, which is usually its synonym. In many puzzles the start of the word chain is not a word but a word root, prefix or suffix, and the other half of the doublet when discovered teaches the student about what the word part means. Some features such as additional clues, part of speech, and sample sentences have been added.

Variation 4C

Game version 4C is a puzzle and a card game. It has the same object as variation 4A, but the player is given only the doublet, with no grid. Sometimes the target number of steps is given. As a game, variation 4C it is played with doublet cards, with the transformation and target number of steps given. Without benefit of the grid these are usually short-path transformations. The card is revealed and the first player to provide the linking words is the winner.

Variation 4C1

Game variation 4C1 is a doublets puzzle and card game just like 4C, but the chain is a three-unit chain and so, given the ends (the doublet), the player only needs to find the middle word. The card set includes doublets that are linked by any of the six transformations as used in game version 4B.

Game 5

In game 5 and its versions, the goal is to find the correct word bit or word chains or clusters given only descriptive clues (as in crossword puzzles) with the benefit of a configured grid and with the type of linking specified. Game 5A is a fun and educational type of puzzle which combines features of crossword puzzles, word transformation, and word find.

Variation 5A

The object of game 5A, a puzzle, is to find the correct word chain linked by double letter change guided only by crossword puzzle-type clues and the constraints and facility of the grid with letter blocks as used in the doublets puzzle in game variation 4A. The object of the puzzle is two-fold: to fill in a grid with four- or five-letter words that are consistent with a theme, based on clues and letters filled in from earlier entries; and to find, using one letter from each word in the chain, the letters of words or phrase that reinforce or define the theme.

Variation 5A puzzles are highly customizable and very suitable for educational use. Clues can be written to provide hints plus information, worded so that use of the dictionary and/or the internet is required, or designed to do both. Themes can range from general topics to science to history. The level of difficulty can be adjusted to match the knowledge and skill level of the student, to ensure that it offers just the right amount of challenge, maintain interest, and provide encouragement and a sense of accomplishment.

Figures 19A, 19B:
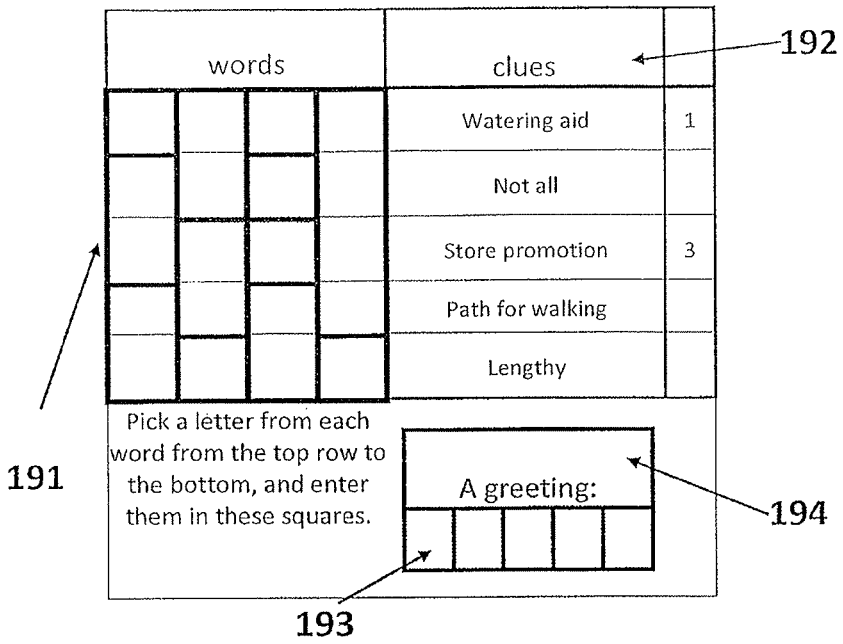
FIG. 19A is a schematic representation of a puzzle in accordance with a twentieth embodiment of the present invention.
FIG. 19B is a solution to the puzzle of FIG. 19A.

FIG. 19A contains a very short but illustrative example of a game 5A puzzle. As can be seen, a first grid 191, similar to the one used in game variation 4A, is provided, having a plurality of rows and columns that intersect to form sections, which can receive a letter, word bit, or the like. A word chain is the solution, but neither of the starting or target words is given. Instead, clues 192 are given for each row, and the letter blocks (similar to variation 4A) of the grid allow the player to fill in letters that help figure out the words in other rows. The solution to each clue 192 is a word that is to be placed in the corresponding row of the first grid 191. A second grid 193 is provided with initially empty spaces corresponding to the number of rows of the first grid 191. The second grid 193 requires some searching as one letter from each word is to be chosen to read, from top to bottom, something coherent and consistent with a final clue 194. In this example, the final clue 194 is "a greeting" and the answer is "H-E-L-L-O" (see FIG. 19B, which provides the solution to the puzzle of FIG. 19A). Due to the small size of this puzzle, there is no theme. Puzzles with as many as 20 or 30 rows are common and very suitable for developing themes.

Variation 5A1

Game variation 5A1 is played the same way as variation 5A, but longer words are used single and/or triple letter changes may be used as the linking type in addition to or instead of double letter change.

Variation 5B

Game version 5B, another puzzle, is similar to variation 5A in that there is only one solution to the chain puzzle and no members of the chain are given. But with the benefit of clues and a constraining grid where adjacent units are required to satisfy the linking type, the puzzle is solvable. The difference between version 5B and version 5A is that the solutions to game version 5B puzzles are clusters instead of simple chains. The grid is similar to that of a crossword puzzle, but each square is filled not with individual letters but with word bits which are linked by word formation.

Figure 20A:
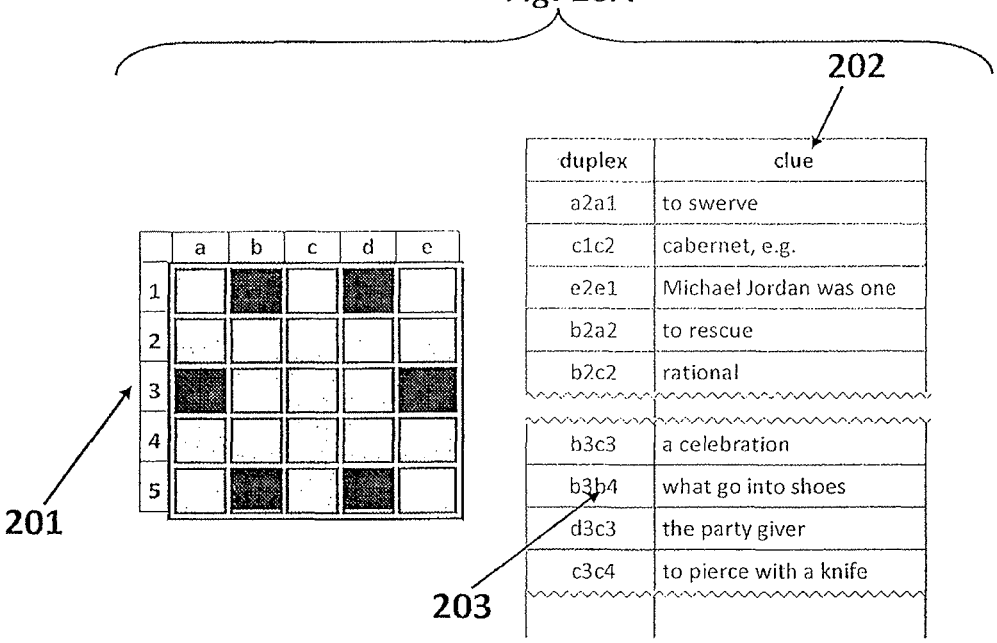
FIG. 20A is a schematic representation of a puzzle in accordance with a twenty-first embodiment of the present invention.
Figure 20B:
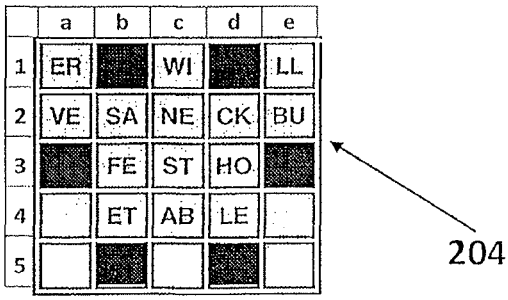
FIG. 20B is a partial solution to the puzzle of FIG. 20A.

For example, FIG. 20A shows an exemplary puzzle grid 201. The squares, each with coordinates of column letter plus row number, are to be filled with word bits. A "duplex" 203, as shown in the list of clues 202 is a pair of two adjacent squares, such as b3 and c3, and e1 and e2. There is one word and one clue per duplex 203, and in the illustrative clues section 202, the duplex 203 is represented by the coordinates of its two squares, given in the beginner version in the direction that the word is read. The partially filled grid 204 is shown in FIG. 20B. Bits in a duplex must form a word (type of linking=word formation) in any of four directions (see FEST and BULL). This type of puzzle can certainly be made much bigger than the example given, such that the words and the clues are consistent with a theme, which would add to its appeal. GENERAL VARIATIONS (Applicable to many games, versions, and variations)

Variation 6A—Change the way of linking.

Variation 6A1—Mutation from Word Formation. Play is the same for word mutation as word formation variation except the basis for forming bit pairs is that the two bits must differ by 1 letter in the same position; or four-letter words tiles are used instead of word bit tiles and the basis for pairing tiles is that they must differ by 1 or 2 letters in the same position. The revision can also occur in the other direction (from mutation to word formation).

Variation 6B—Change the word length.

Variation 6B1—Play is the same except letter tiles are included with the two-letter word bit tiles; and two, three, and four letter words are formed.

Variation 6B2—Play is the same except that five-letter words are formed by adding one individual or undeclared letter to the two two-letter word bits.

Variation 6B3—Play is the same except that six-letter words are formed by adding two individual or undeclared letters to the two two-letter word bits.

Variation 6C—Change the linking configuration created.

Variation 6C1—Play is the same as when forming pairs except that a three-unit chain is formed using the same linking type, and the credited number is the number of chains as opposed to the number of words.

Variation 6C2—Play is the same as when forming pairs except that the object is changed from forming the most pairs to forming the longest chain using the same linking type. The credited number is the number of units in the chain.

Variation 6C3—Play is the same as when forming pairs except that the object is changed from forming the most pairs to forming the highly branched chain with the most links of the same type. The credited number is the number of links.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method of playing a word game among two or more participants, the method comprising:

(a) providing a plurality of game pieces, wherein each of the game pieces includes a single two-letter word bit, each word bit being a fixed ordered two-letter combination;

(b) providing a plurality of skill cards, wherein each skill card includes a target number of words of at least four letters, the target number of words on at least two of the skill cards being different from one another;

(c) providing a first portion of the game pieces to each of the two or more participants to create a personal pool for each of the two or more participants;

(d) providing each of the two or more participants with a respective one of the skill cards, wherein the target number of words on the respective skill card provided to each participant is based on a skill level of the corresponding participant;

(e) providing a second portion of the game pieces into a supply pool; and (f) allowing each of the two or more participants to create words of at least four letters by combining the game pieces from the respective participant's personal pool; and (g) ending a round of play when a first of the participants create the target number of words assigned thereto by the corresponding skill card from the first of the participants' personal pool of game pieces.

2. The method of claim 1, further comprising:

(h) ending the game when a participant has won a predetermined number of rounds.

3. The method of claim 1, further comprising:

(h) providing each personal pool with a minimum number of game pieces required to create the target number of words assigned to the respective participant.

4. The method of claim 1, further comprising:

(h) providing the winner of a round with a token, the token increasing the winner's target number of words of at least four letters by one in a subsequent round of play.

5. The method of claim 1 further comprising:

(h) allowing each of the participants to exchange at least one game piece from the respective participant's personal pool for an equal number of game pieces from the supply pool.

* * * * *